United States Patent [19]

Cushman

[11] 3,934,515

[45] Jan. 27, 1976

[54] TRANSPORTATION SYSTEM

[75] Inventor: Walton W. Cushman, Fraser, Mich.

[73] Assignee: Lon H. Romanski, Sterling Heights, Mich.

[22] Filed: Nov. 25, 1974

[21] Appl. No.: 526,916

Related U.S. Application Data

[62] Division of Ser. No. 304,903, Nov. 9, 1972.

[52] U.S. Cl. ..... 104/18; 104/25; 104/20; 198/76

[51] Int. Cl.[2] ..... B61K 1/00

[58] Field of Search ..... 198/110, 76, 102; 104/18, 104/20, 25

[56] References Cited

UNITED STATES PATENTS

| | | | |
|---|---|---|---|
| 1,437,550 | 12/1922 | Putnam | 104/25 |
| 2,044,134 | 6/1936 | Storer | 104/25 |
| 3,421,450 | 1/1969 | Bell | 104/20 |

*Primary Examiner*—M. Henson Wood, Jr.
*Assistant Examiner*—D. W. Keen
*Attorney, Agent, or Firm*—Lon H. Romanski

[57] ABSTRACT

A transportation system is comprised of a first closed loop passenger and cargo transporter section with such section being ideally intended to operate at a substantially constant speed, and a second closed loop passenger transfer section with such section being intended to operate, generally between the first closed loop and a related stationary passenger platform, as to cyclically maintain a speed equivalent to the constant speed of the first closed loop, then decelerate until it is stationary with respect to the related stationary passenger platform and then accelerate until it is again at the speed of the first closed loop transporter section. Passengers and cargo may, during the time that the transfer section is stationary with respect to the passenger platform, transfer from the platform onto the then stationary transfer section (or if getting off of the system, transfer from the then stationary transfer section onto the platform). After the second closed loop transfer section has accelerated and attained the speed of the moving first closed loop transporter section, the passengers on the transfer section may, during the time that both sections are of the same speed, transfer from the transfer section onto the transporter section (or, if in the process of getting off of the system, transfer from the transporter section onto the transfer section). After the second closed loop transfer section has decelerated and again becomes stationary with respect to the stationary passenger platform, such passengers getting onto or getting off the system may again, as the case may be, transfer from the stationary platform onto the transfer section or transfer from the transfer section onto the platform. The above cycle of operation continues during operation of the overall transportation system.

17 Claims, 26 Drawing Figures

TRANSPORTATION SYSTEM

This is a division of application Ser. No. 304,903 filed Nov. 9, 1972.

BACKGROUND OF THE INVENTION

It is an established fact that large cities and congested urbanized areas have long needed systems for the mass transportation of their inhabitants. The increased use of buses operating on city streets has not even begun to show any solution to the problem of mass transportation.

Heretofore various so-called "new" concepts in mass transit systems have been offered. Such prior art proposed "new" systems have included subway installations, surface track systems, and mono-rail systems. However, none of such prior art systems are really new in that all of them employ either the conventional train (composed of a plurality of interconnected rail cars) or individual and separate rail cars (sometimes referred to as "cabs") each provided with its own motor means.

The only real difference between such above prior art systems and the earliest forms of transit systems is that electronic computers are now often employed in an attempt to control such operating parameters as, for example, the speed of the trains and individual motorized rail cars, the spacing between succeeding trains or individual motorized rail cars, the stopping of such trains and motorized rail cars at various areas for passenger boarding and de-boarding, and, often, maintaining an electronic record of the ever-changing location of the trains, and especially, the individual motorized rail cars within the overall transit system. Aside from other problems, experience has proven that such electronic computers are, for various reasons, less than reliable in the performance of their intended functions.

The main deficiency of such prior art systems resides in the fact that they still fail to provide a transit system that: (a) is relatively cheap to build, operate and maintain; (b) is safe in its operation; and (c) has a passenger capacity which not only meets the present needs of any urbanized area—which the prior art systems fail to do—but also provide the added capacity needed to accommodate future growth of any such urbanized area.

More specifically, each of the prior art systems employ transporter containers (the term, containers, being used generically to include either or both trains or individual motorized rail cars) which have to stop to permit boarding and de-boarding of passengers. This, of course, means that other passengers within the container also have to experience the deceleration, waiting for other passengers to board and de-board, and then undergo acceleration. If a particular passenger, for example, boarded the container at one end of the system with the destination being the other end of the system, such particular passenger would have to experience stopping for every passenger station along the system. Such cyclic stopping and starting, aside from being an inconvenience to the passengers not boarding or de-boarding, is wasteful of energy in that energy is consumed during both deceleration and acceleration of the transporter container and all the passengers therein even though only a single passenger may wish to de-board at a particular station.

Such prior art systems, in attempting to compensate for the time lost during such cyclic deceleration, stopping and acceleration of the transporter containers, have increased the maximum speeds of such transporter containers. However, in so doing, because of safety reasons, the spacing between succeeding transporter containers has been drastically increased in an attempt to prevent a following transporter container from colliding with a disabled transporter container in its path. As a consequence of such increased spacing, the total number of transporter containers in the overall system has to be reduced thereby significantly reducing the passenger-carrying capacity of the entire system.

Accordingly, the invention as herein disclosed and described is directed primarily to the solution of the above and other attendant problems.

SUMMARY OF THE INVENTION

According to the invention, a transportation system comprises a first closed loop transporter means effective for continuously moving in said closed loop, at least a plurality of stationary stations, second closed loop transfer means located as to be generally between at least certain of said stations and said transporter means, and propelling means, said propelling means being effective to cause said transporter means to continuously move at a generally constant speed and to cause said transfer means to cyclically maintain a speed substantially equivalent to the speed of said transporter means for a first period of time then to cause said transfer means to decelerate until it is at least substantially stationary with respect to said at least certain of said stations for a second period of time then to cause said transfer means to accelerate until it is again at a speed substantially equivalent to the speed of said transporter means.

Various general and specific objects and advantages of the invention will become apparent when reference is made to the following detailed description considered in conjunction with the accompanying drawings.

BRIEF DESCRIPTION OF THE DRAWINGS

In the drawings, wherein for purposes of clarity certain details or elements may be omitted from one or more views.

DETAILED DESCRIPTION OF PREFERRED EMBODIMENTS

Figure 1:
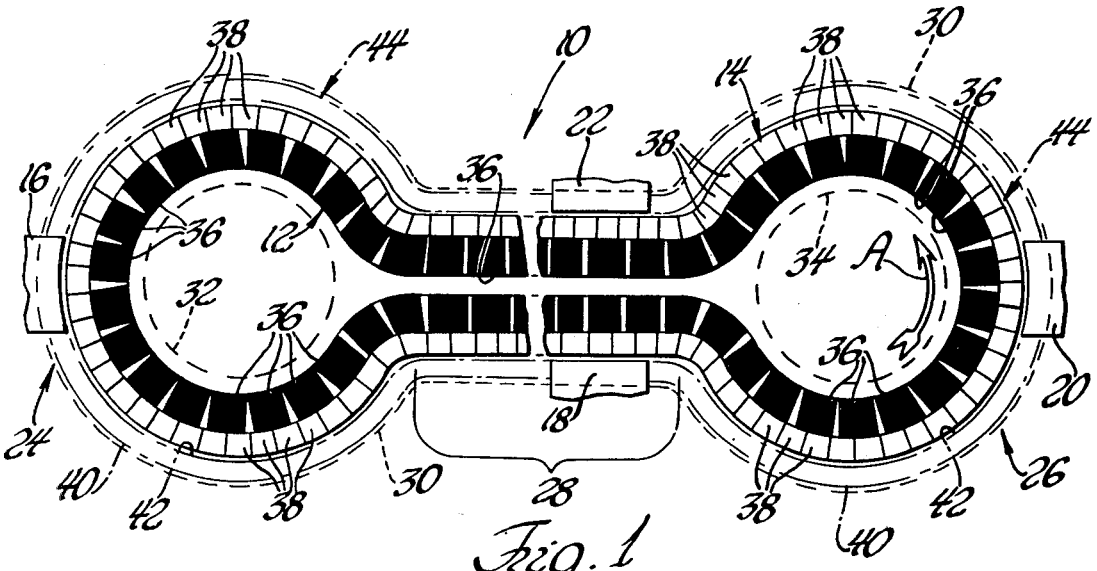
FIGS. 1, 2, 3 and 4 are each schematic illustrations of a transportation system embodying the teachings of the invention.

Referring now in greater detail to the drawings, FIG. 1 schematically illustrates the transportation system 10 as comprising an inner closed loop transporter means 12 and cooperating closed loop transfer means 14. A plurality of station areas are schematically illustrated at 16, 18, 20 and 22. As shown, the system 10 may comprise end portions 24 and 26 the function of which is to complete the loop configuration. Intermediate such end portions 24 and 26 may be an elongated section, as generally designated at 28, with what may be termed run portions effectively interconnecting the end portions 24 and 26 and moving in directions opposite to each other. The entire transit system 10 may be enclosed in suitable housing means as generally diagrammatically depicted by the long dash lines 30, 32 and 34. Such housing means may, of course, take the form of a subway, ground level system or an elevated system or, in fact, even a combination of all or any of such systems.

In such an arrangement as depicted by FIG. 1, the interconnecting run section 28 could easily be enclosed within a relatively narrow housing section as to thereby have the two run portions in close proximity to each other (as, for example, within a single tube of a subway system) but moving in opposite directions.

The first closed loop transporter means 12 is, in the preferred form of the invention, comprised of a plurality of pallets, platforms, cars or carriers 36, preferably of modular construction, which are serially interconnected to thereby form the closed loop configuration. The second closed loop transfer means 14 is, somewhat similarly comprised of a plurality of platforms or carriers 38, preferably of modular construction, which also are serially interconnected to thereby form the second closed loop configuration.

Further, even though 16, 18, 20 and 22 have been employed to designate station areas, this does not mean that there are only a limited number of areas where passengers may board or de-board the moving portion of the transit system. On the contrary, in the preferred form of the invention there would be a stationary platform area extending about the entire system. For purposes of illustration and ease of recognition, such has been shown in phantom lines at 40 and 42 defining therebetween such continuous platform area 44. (It should, of course, be apparent, especially as the description of the invention progresses, that in actual installations of a transit system employing the teachings of the invention, for reasons which may arise during actual design and installation, such a continuous platform area 44 could not be achieved. Such would not in any way be a departure from the scope of this invention.) Accordingly, for purposes of discussion, such station areas as 16, 18, 20 and 22 are better thought of as being particular areas where passengers may enter and leave the overall transit system. These areas could be designated as by names of city streets in close proximity thereto.

The operation of the invention as generally depicted in FIG. 1 is as follows. First, let it be assumed that both the first closed loop transporter means 12 and the second closed loop transfer means 14 are moving in a direction as indicated by arrow A and that each are traveling at a constant speed of 30.0 mph. During this period of synchronous operation, any passengers on the first closed loop transporter means 12 who wish to de-board may step from means 12 onto the second closed loop transfer means 14. After a preselected elapsed time, the transfer means 14 undergoes deceleration, with respect to the platform area 44, until it finally becomes stationary with respect to such platform area 44. During the time that transfer means 14 is thusly stationary, those passengers in the process of de-boarding, and who have previously transferred from the transporter means 12 to the transfer means 14 during synchronous operation thereof, may now step from transfer means 14 onto the platform or loading means 44, and subsequently walk out of one of the station areas 16, 18, 20 or 22. At the same time, while the transfer means 14 is still stationary, those on the platform area may start their boarding process by stepping from the platform area 44 onto the transfer means 14. During the time that the transfer means 14 is thusly stopped alongside the platform area 44, the transporter means 12, of course, continues moving at the assumed speed of 30.0 mph.

After a preselected interval of time, the transfer means 14 starts accelerating until such time as its speed is again that of the transporter means 12 so that there is, for all practical purposes, no relative motion as between transfer means 14 and transporter means 12. When this synchronous condition is attained, those who previously started their boarding operation by stepping onto transfer means 14 from the stationary platform area 44, now complete their boarding operation by stepping from the transfer means 14 onto the transporter means 12 while those who wish to de-board step from transporter means 12 and onto transfer means 14. The cycle then repeats itself in the manner described.

In view of the preceding it should be apparent that the boarding and de-boarding of passengers can take place over the entire length of the closed loop system because whenever the transfer means 14 comes to a stop, it is stopped throughout its closed loop. Accordingly, the loading and unloading capacity of the transit system 10 far exceeds the capacity of any other transit system heretofore proposed. Moreover, such extremely great loading capacities attainable by the invention are not achieved with any resulting reduction in either the number of passengers transported per unit of time by the transporter means 12 or the speed at which such passengers are being transported by the transporter means 12 because the loading-unloading function and the transporting function of the transit system are separate and not dependent upon each other.

Figure 2:
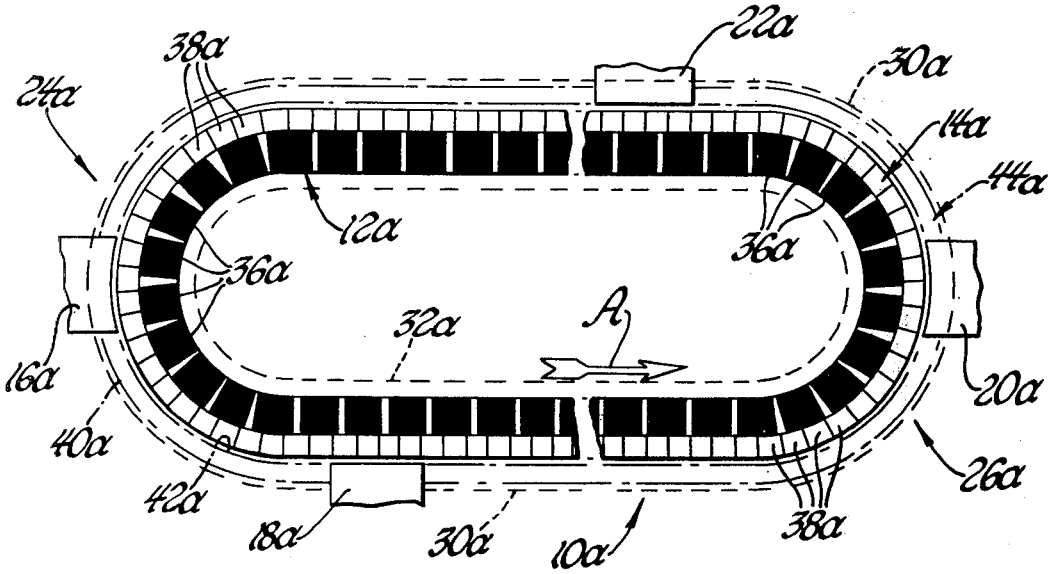

In the schematic view comprising FIG. 2, all elements which are like or similar to those of FIG. 1 are identified with like reference numerals with a suffix "*a*". The main difference between the drawings of FIGS. 1 and 2 is that the structure of FIG. 1 contemplates the possibility of having at least some part of the medially disposed section 28 situated within a common housing as to have, within such section, movement of passengers both to the left and right while in the FIG. 2 arrangement the housing means, identified as at 30*a* and 32*a*, also forms a single closed loop.

The FIG. 1 arrangement might better lend itself to, for example, the median of an automobile expressway while the arrangement of FIG. 2 might be one where, for example, the transporter means 12 moves to the right along one particular traffic corridor of a city and moves to the left along another traffic corridor of that city where such corridors are spaced one or more city blocks from each other. The overall operation of the transit system 10*a* of FIG. 2 is like that described with reference to FIG. 1.

Figure 3:
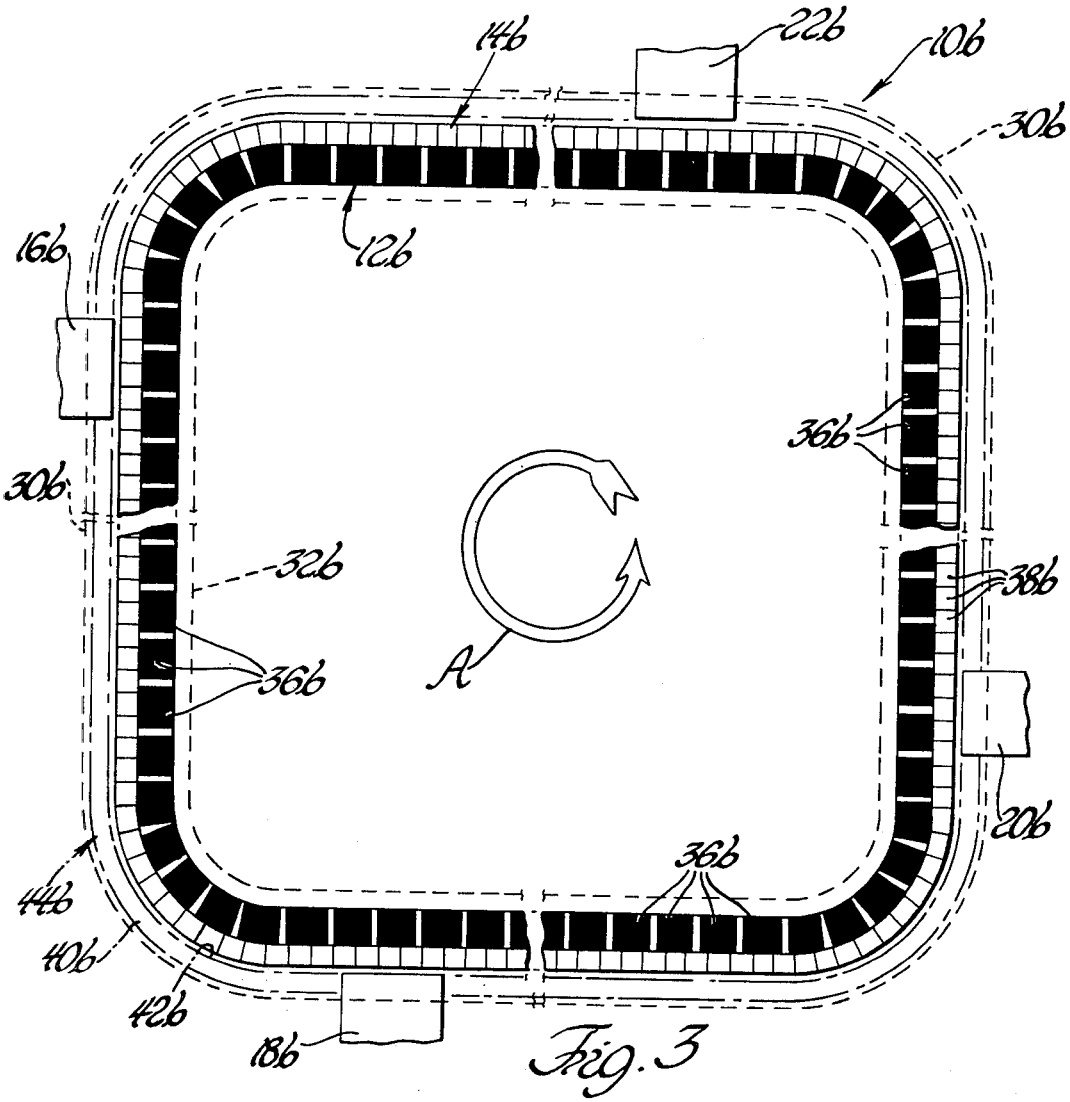

FIG. 3, in which all elements like or similar to either FIGS. 1 or 2 are identified with like reference numerals provided with a suffix "*b*", illustrates a transit structure like that of FIG. 2 except that it contemplates a transit system which might well form a relatively large closed loop within, for example, a major city so as to provide a belt-like major transit system which might, in turn, cooperate with other satellite type transit systems for completing an overall integrated urban transit system. The operation of the overall transit system 10*b* is like that described with reference to FIG. 1.

Figure 4:
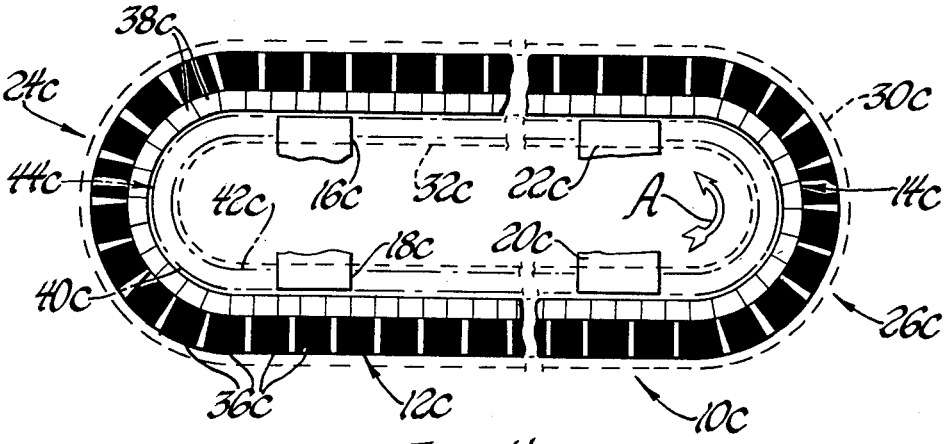

FIG. 4, in which all elements like or similar to FIG. 2 are identified with like reference numerals provided with a suffix "*c*", illustrates a transit system 10*c* which is like that of FIG. 2 with the exception that the closed loop transfer means 14*c* is placed peripherally inwardly of the closed loop transporter means 12, and the station areas 16*c*, 18*c*, 20*c* and 22*c* as well as the platform area 44*c* are placed peripherally inwardly of the closed loop transfer means 14*c*. This is merely to illustrate that the practice of the invention is not limited to having such transfer means 14 and platform areas peripherally outwardly of the transporter means 12. The overall operation of the transit system 10*c* is like that described with reference to FIG. 1.

Figure 5:
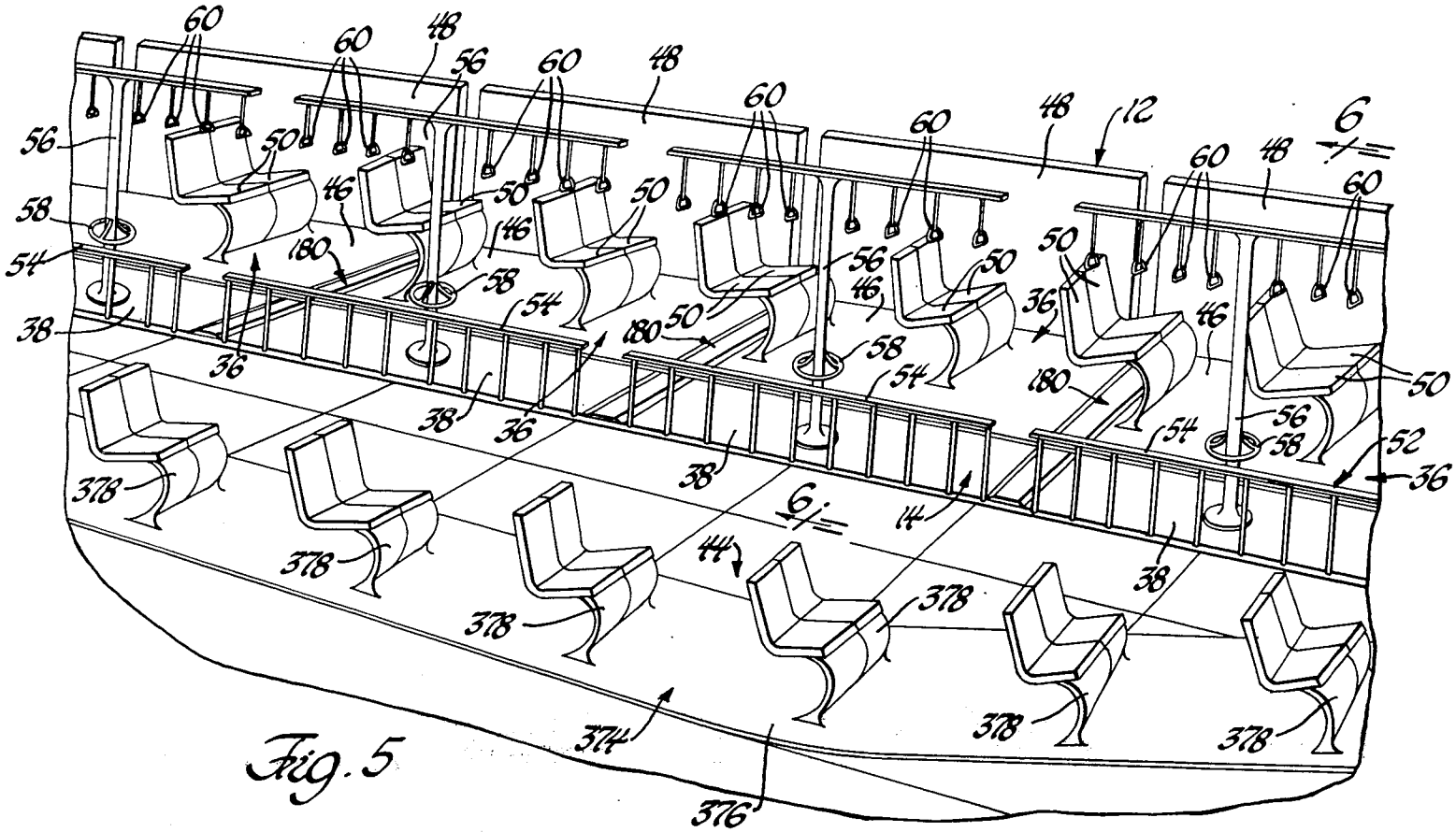
FIG. 5 is an enlarged perspective view of a fragmentary portion of the transit system of, for example, FIG. 1.

FIG. 5 illustrates in perspective a fragmentary portion of the transit system 10 as might occur, for example, in that portion of section 28 of FIG. 1 moving to the right. Further, merely for sake of illustration, it is assumed that the transit system 10 is at least partly a subway (subterranean).

Referring in greater detail to FIG. 5, it can be seen that the modular cars, pallets or carriers 36 are serially connected to each other so that, functionally, such serially connected carriers 36 define closed loop conveyor means. Preferably, each of the carriers 36 comprise a base portion 46 and an integrally formed generally vertically extending wall portion 48. The base portions 46 of each of the carriers 36 may, in turn, carry a plurality of chairs 50 which are illustrated as being preferably integrally formed with the carrier.

As also can be seen, the transfer carriers or sections 38 are serially connected to each other so that, functionally, such serially connected modular sections 38 define closed loop conveyor-like means.

As will become more apparent later, in the preferred embodiment of the invention two gate or barrier systems are employed with the first such system being carried by the transporter means 12 and the second system 52, comprised of for example gates 54, being carried by transfer means 14. In FIG. 5, the transit system is illustrated as being in a condition of operation wherein the velocities of the transfer means 14 and transporter means 12 are the same (as previously described with reference to FIG. 1). At this condition of operation the gate or barrier system carried by the transporter means 12 is opened and, in the form of the invention shown, the opening of either gate system is achieved by having that particular gate system move downwardly until the top or railing of the gate is generally level with the floor or walking surface of the carriers 36 or 38.

Although not essential to the practice of the invention, it is nevertheless contemplated that if need should arise, suitable means such as a vertically extending post 56 would, in turn, be provided with suitable means, such as ring portion 58 and a plurality of hand straps 60 which passengers on the transfer means 14 and in the process of either boarding or de-boarding the transit system can grasp in order to stabilize themselves.

Figure 6:
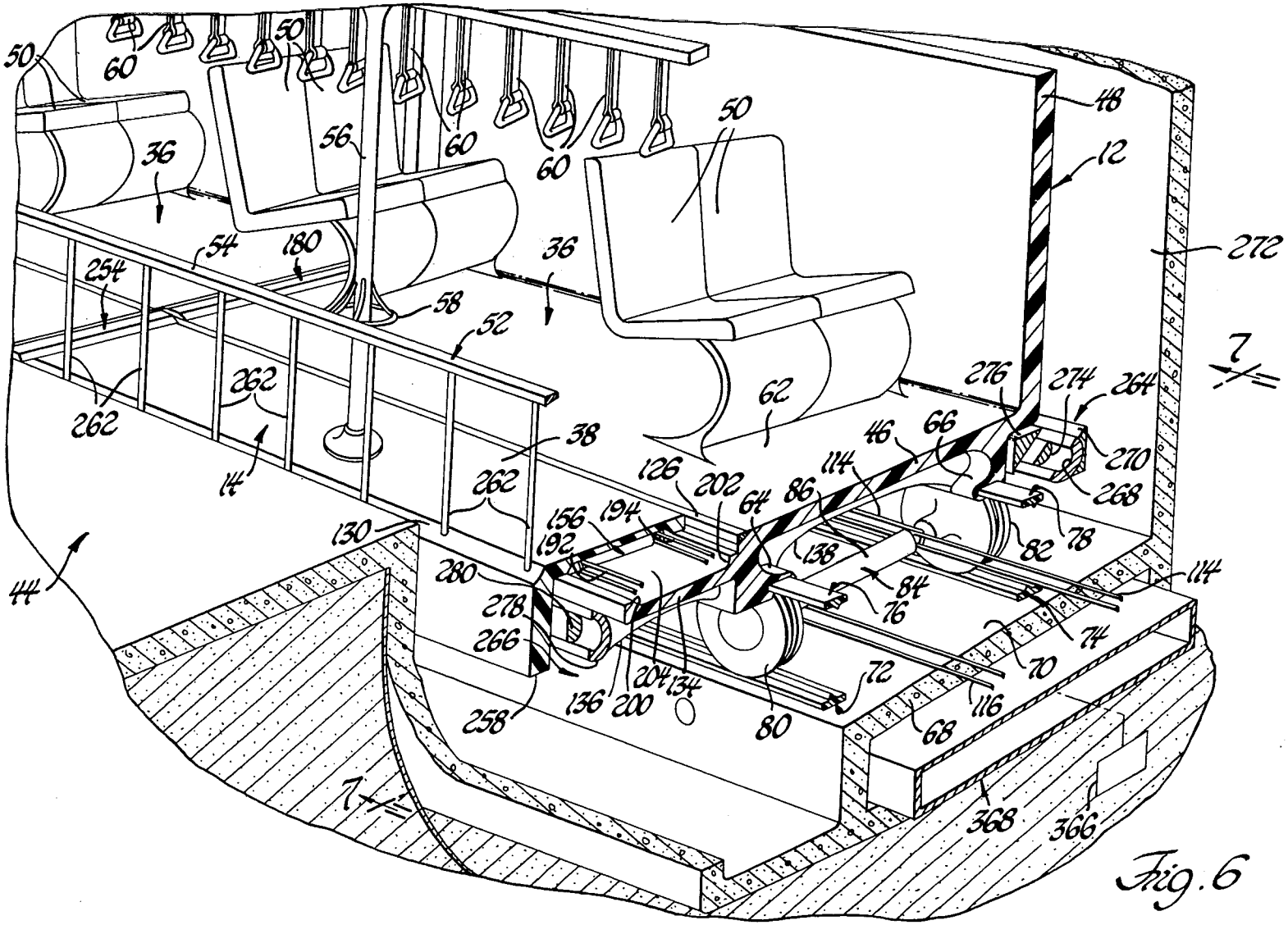
FIG. 6 is an enlarged cross-sectional view taken generally on the plane of line 6—6 of FIG. 5 and looking in the direction of the arrows.

FIG. 6 is an enlarged fragmentary view of a portion of FIG. 5 taken generally on the plane of line 6—6 of FIG. 5 and looking in the direction of the arrows. (Many of the elements shown in FIG. 6 are illustrated as being sectioned in planes parallel to each other merely because such better illustrates their relative relationships.)

As typically shown in FIG. 6, the base 46 of each carrier 36 has an upper floor surface 62 and lower downwardly depending rail-carrying portions 64 and 66 situated in spaced relationship to each other generally at opposite sides of the carrier 36. A suitable base or support structure 68, which, as illustrated, may comprise a concrete bed surface 70, provides support for a pair of rails 72 and 74 laterally spaced from each other and respectively extending in a generally closed loop manner for the length of the entire closed loop transporter means 12. A second pair of rails 76 and 78 are respectively suitably secured to rail supports 64 and 66. Rails 76 and 78 as well as rails 72 and 74 are spaced from each other like distances in order to have rolling engagement with spaced wheels 80 and 82 of a wheel assembly or structure 84 which includes an interconnecting shaft portion 86 preferably formed integrally with the wheels 80 and 82.

Figure 7:
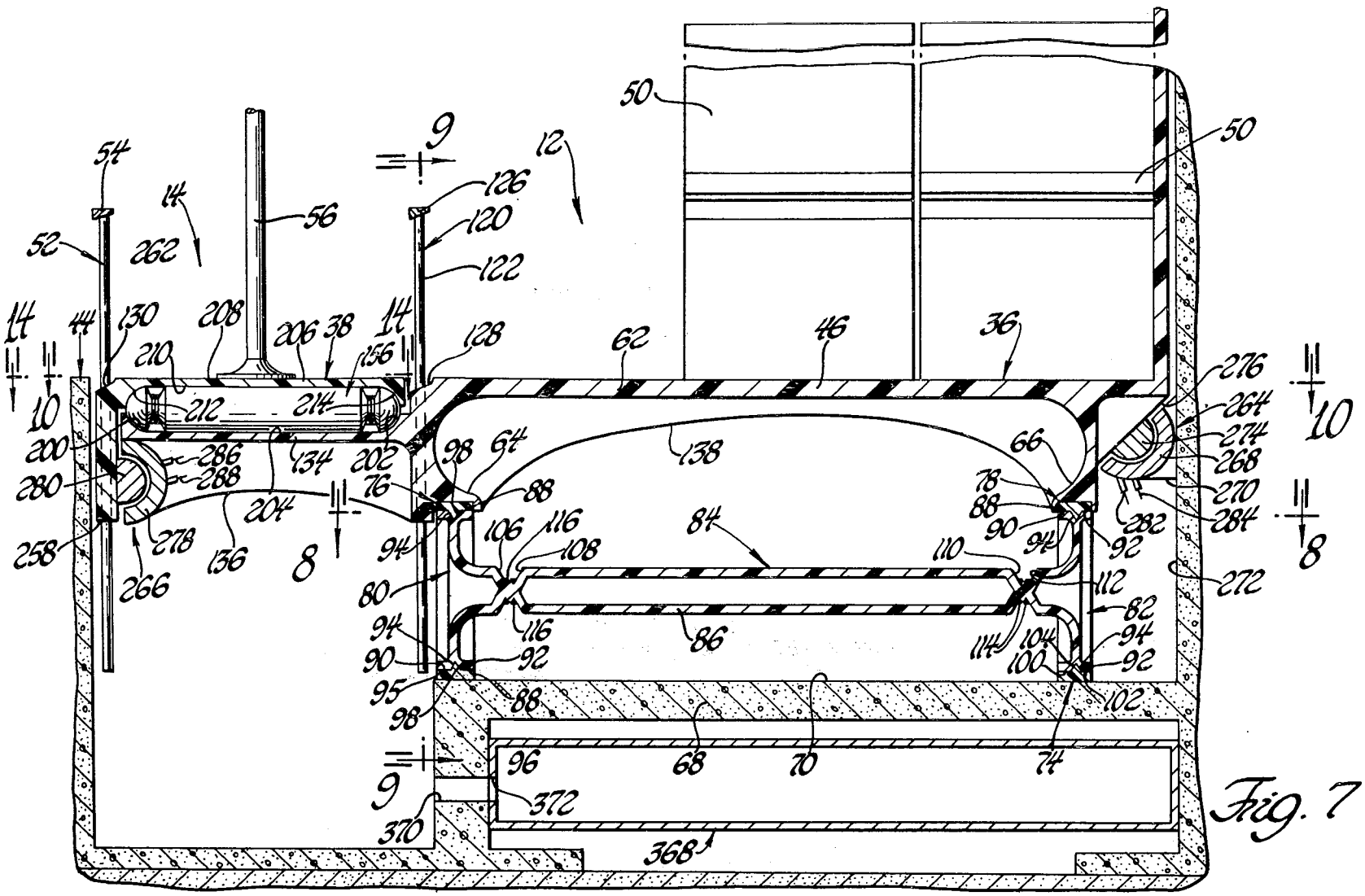
FIG. 7 is a further enlarged view taken generally on the plane of line 7—7 of FIG. 6 and looking in the direction of the arrows.

FIG. 7, an enlarged cross-sectional view taken generally on the plane of line 7—7 of FIG. 6 and looking in the direction of the arrows, illustrates that in the preferred embodiment, each of the track rails is formed to have the same effective cross-sectional configuration. For example, as typically illustrated by track or rail 72, each rail is provided with a base portion 88 defining tread surfaces 90 and 92 with a continuous upstanding guide portion 94 formed between such tread surfaces.

Wheel 80 is, in turn, provided with circumferential or cylindrical surfaces 95 and 96 which respectively rollingly engage tread surfaces 90 and 92 of upper and lower tracks 76 and 72, while a circumferentially formed groove or recess 98 receives therein guide portions 94 of the same rails.

Similarly, wheel 82 is provided with circumferential or cylindrical surfaces 100 and 102 which respectively rollingly engage tread surfaces 90 and 92 of upper and lower tracks 78 and 74 while a circumferentially formed groove or recess 104 receives therein guide portions 94 of such rails 78 and 74.

As illustrated in FIG. 7, the wheel structure 84 is preferably formed as to have the interconnecting shaft portion 86 hollow and the disc portions of wheels 80 and 82 generally dished thereby to some degree enhancing the resiliency of the wheels. In addition, a plurality of annular V-type grooves 106 and 108 are formed in shaft portion 86 near one end thereof while a second plurality of annular V-type grooves 110 and 112 are formed near the other end of shaft portion 86. Such V-type grooves accommodate the placement generally thereabout of coacting endless belt means as are typically illustrated in, for example, FIGS. 6, 7 and 8.

Figure 8:
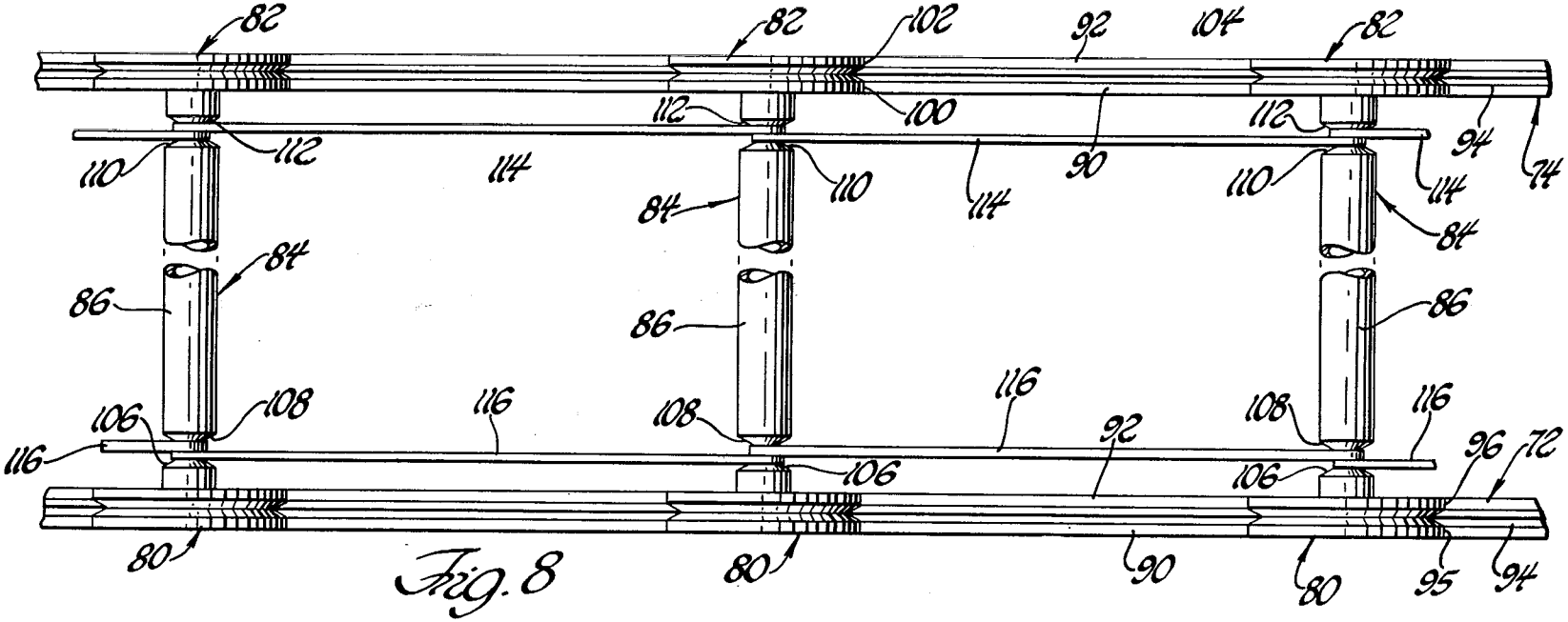
FIG. 8 is a view taken generally on the plane of line 8—8 of FIG. 7, with certain elements removed for purposes of clarity, and looking in the direction of the arrows.

Referring now in greater detail to FIG. 8, which illustrates only a few of the wheel assemblies 84, it can be seen that a first plurality of continuous spacer belts 114 are operatively engaged with the wheel assemblies 84 in one set of V-grooves while a second plurality of continuous spacer belts 116 are operatively engaged with the wheel assemblies 84 in the opposite set of V-grooves.

For example, one of the first plurality of continuous belts 114 is shown being looped about the axle 86 of the left-most wheel assembly 84, within V-groove 112, and similarly looped about the axle 86 of the middle wheel assembly 84, also within that wheel assembly's V-groove 112. A second of the first plurality of continuous belts 114 is shown being looped about the axle 86 of the middle wheel assembly 84, within V-groove 110, and similarly looped about the axle 86 of the right-most wheel assembly 84, also within that wheel assembly's V-groove 110.

A one of the second plurality of continuous spacer belts 116 is shown being looped about the axle 86 of the left-most wheel assembly 84, within V-groove 106, and similarly looped about the axle 86 of the middle wheel assembly 84, also within that wheel assembly's V-groove 106. A second of the second plurality of continuous spacer belts 116 is shown being looped about the axle 86 of the middle wheel assembly 84, within V-groove 108, and similarly looped about the axle 86 of the right-most wheel assembly 84, also within that wheel assembly's V-groove 108.

As indicated by the fragmentary portions of continuous belts 114 and 116, such are connected to both trailing and leading wheel assemblies as to thereby define a continuous closed-loop wheel-belt assembly for supporting the carriers 36.

Ideally, the center-to-center spacing of succeeding wheel assemblies 84 is such as to result in at least two such wheel assemblies 84 always being beneath every one of the carriers 36.

At this time it might be best to point out that in the preferred embodiment of the invention the carriers 36 would be of a one-piece construction molded as by foamed plastic process employing any suitable material. The tracks or rails 72, 74, 76 and 78 would be preferably formed of elastomeric material such as a tough and durable urethane, as by extrusion. Similarly, although the wheel assemblies 84 may be formed of any suitable material, it is also preferred that such be molded from a suitable plastic material.

Figure 9:
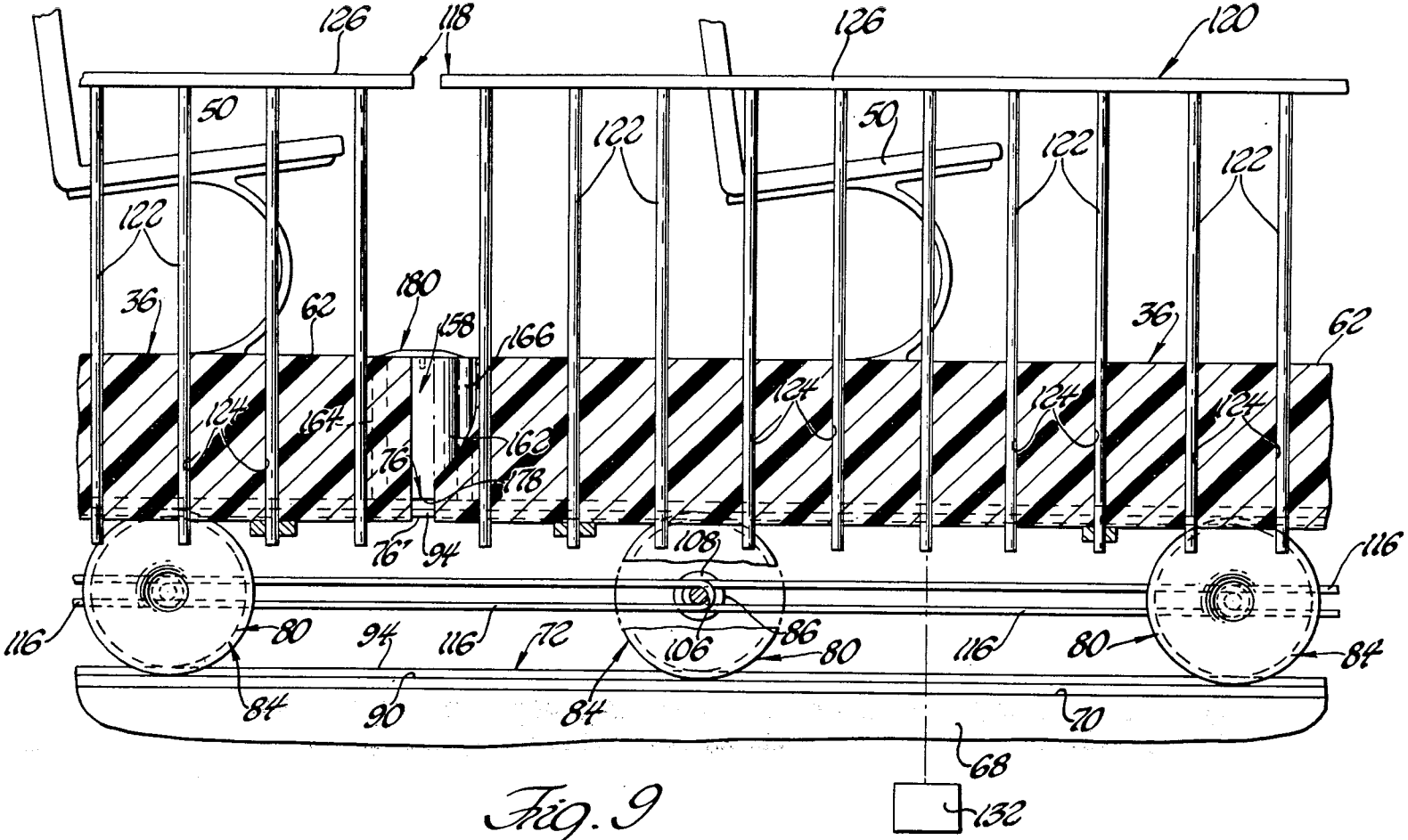
FIG. 9 is a cross-sectional view taken generally on the plane of line 9—9 of FIG. 7 and looking in the direction of the arrows.

FIG. 9, a cross-sectional view taken generally on the plane of line 9—9 of FIG. 7, illustrates, generally, the placement of the wheel assemblies 84 beneath the carriers 36. As can be seen, in the preferred embodiment of the invention, the wheel assemblies 84 are not journalled to the carriers 36 but instead are in rolling engagement with the lower tracks 72 and 74 as well as the upper tracks 76 and 78. Consequently, if the carriers 36 are assumed to be traveling at 30.0 mph, the velocity of the center of wheel assemblies 84 will only be half of the speed of carriers 36 (15.0 mph).

The inner gate or barrier means 118 is shown as being comprised of individual gate means 120 having banister-like portions 122 slideably received in cooperating guide passages 124 formed in each of the carriers 36. The banister portions 122 in turn support a generally horizontally disposed railing 126. In FIG. 7 the gate means 120 is illustrated in a partly lowered position whereas in FIG. 9 the same gate means 120 is shown in a fully raised position. With reference to FIG. 7, it can be seen that in the preferred form of the invention, the railing 126 is of such a cross-sectional configuration as to be accommodated within a chamfered portion 128 of carrier 36 when the gate means 120 is fully lowered thereby causing the top surface of railing 126 to be an extension of the floor surface 62. The same applies to rail 54 of gate means 52 and the chamfered portion 130 of transfer carrier 38. Of course, any suitable means can be employed for raising and lowering the gate means 120 and 52 as generally schematically illustrated at 132 of FIG. 9. Such means may take the form of electric or pneumatic motors, for example, and, if desired, using any such appropriate motor in combination with negator type springs. Such negator springs are well known in the art for use in areas where it is desired to effectively off-set or counter-balance the weight of a related member which, in this case, would be the gate means. The precise means by which such barrier means are raised and lowered forms no part of this invention and, of course, the practice of this invention is not limited to any such specific actuating or control means.

Referring again to FIGS. 6 and 7, it can be seen that each of the modular carriers 36 is provided with an integrally formed laterally extending flange or support platform portion 134. Suitable ribs or gussets 136 may also be integrally formed therewith as to provide additional rigidity. Similarly, reinforcing ribs or members 138 may be provided on the underside of and integrally with the modular carrier 36 in a manner strengthening rail support portions 64 and 66. The platform portion 134, in turn, supports and carries the transfer means 14 in a manner to be described.

Figures 10, 11:
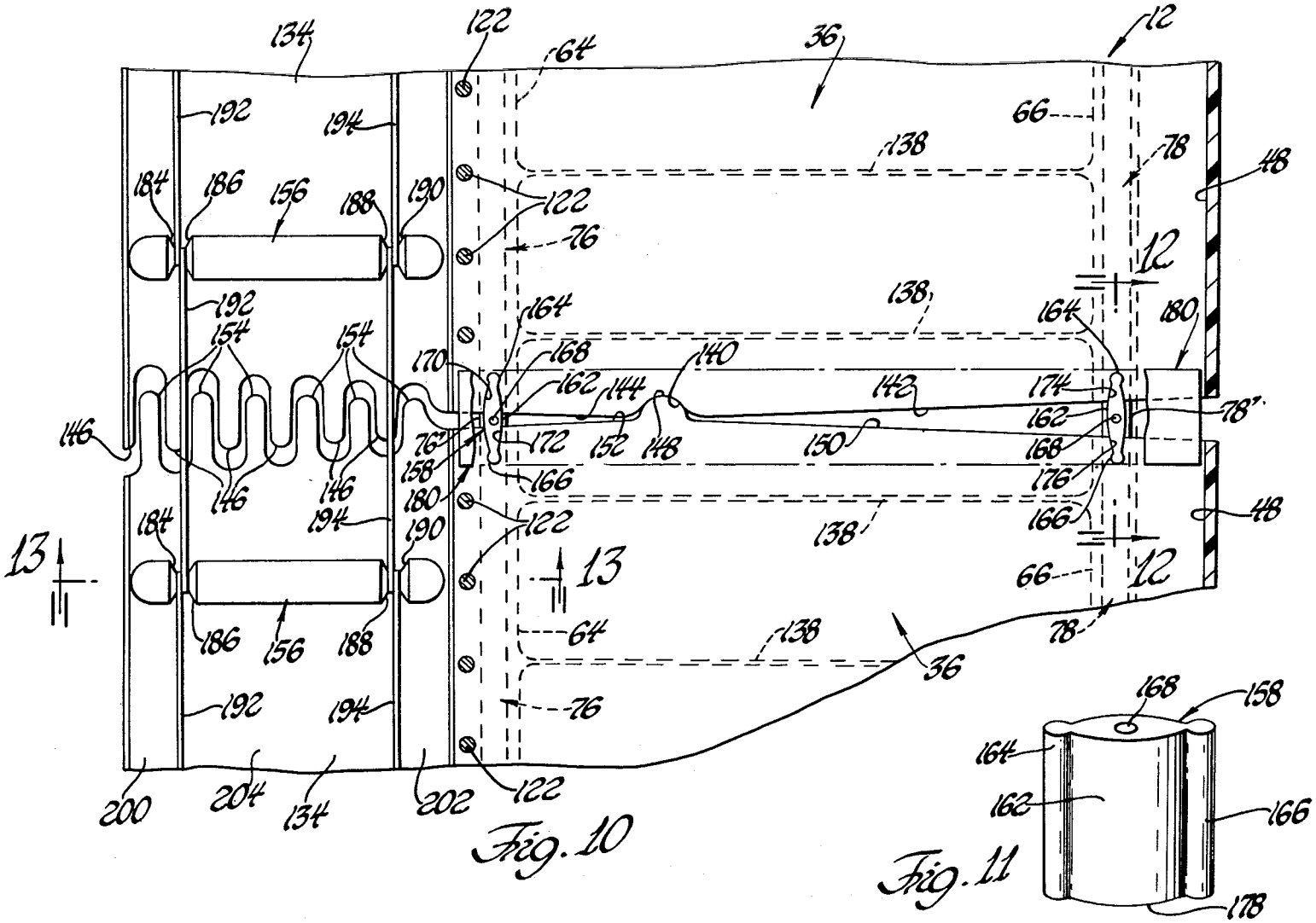
FIG. 10 is a view taken generally on the plane of line 10—10 of FIG. 7 with certain portions removed for purposes of clarity.
FIG. 11 is an enlarged perspective view of one of the elements shown in FIG. 10.

FIG. 10, a fragmentary top plan view taken generally on the plane of line 10—10 of FIG. 7 with certain elements and portions omitted or removed for purposes of clarity, illustrates the manner in which two succeeding modular carriers 36 may be operatively connected to each other. For example, the forward or leading end of each of the carriers 36 may be provided with a socket-like bearing surface or recess 140 with a first end surface 142 blending therefrom and inclined with reference to a transverse plane normal to the carrier 36. A second leading end surface 144, generally blending with the recess 140, comprises a plurality of finger-like projections or extensions 146 with such extensions being formed in the laterally extending support portion 134.

The trailing end of each of the carriers 36 may be provided with an arcuate projection 148 pivotally received in and cooperating with recess 140. A first trailing end surface 150 blends with projection 148 and extends therefrom as to be generally inclined with reference to a transverse plane normal to the carrier 36. A second trailing end surface 152, generally blending with projection 148, comprises a plurality of finger-like projections or extensions 154, with such extensions being formed in the laterally extending support or flange portion 134 of carrier 36.

As can be best seen in FIG. 10, the leading edge fingers 146 and trailing edge fingers 154 are so spaced and of such effective lengths as to place such fingers or extensions in a generally interleaved relationship and to permit substantial arcuate or pivotal motion of succeeding carriers generally about the axis of recess 140 or bearing means defined by 140 and 148. As will become even more evident, such generally interspersed fingers or extensions 146 and 154 serve to provide a continuous supporting surface for wheel or roller means 156 of the transfer means 14 while still enabling a degree of relative arcuate movement as between succeeding carriers 36.

The respective succeeding pairs of carriers 36, as best illustrated in FIG. 10, are effectively joined to each other as by spaced connecting members 158 and 160. Typically, such connecting members are comprised as illustrated by 158 shown in perspective in FIG. 11.

Referring to both FIGS. 10 and 11, it can be seen that each of the connectors is comprised of a main generally elongated body 162 having integrally formed anchoring portions 164 and 166 coextensive with the length of the body 162. Further, in the preferred form, the connector has an aperture 168 formed in the body portion 162. Each of the connectors 158 and 160 are formed of a suitable elastomeric material.

Referring to FIG. 10, a first contoured cut-out or opening 170, formed in the leading end of the trailing carrier 36, closely conforms to the outer configuration of connector 158 and accepts therein a portion of body 162 as well as anchor portion 164; another portion of body 162 and the opposite anchor portion 166 of the same connector 158 are similarly received in a cut-out or opening 172 formed in the trailing end of juxtaposed leading carrier 36. The trailing carrier 36 has a second cut-out or opening 174 which closely conforms to the outer configuration of connector 160 and accepts therein a portion of body 162 as well as its anchoring portion 164 of such connector 160; another portion of body 162 and the opposite anchoring portion 166 of connector 160 are similarly received in a cut-out or opening 176 formed in the trailing end of the leading carrier 36.

When such elastomeric connectors 158 and 160 are so assembled to any two succeeding carrier modules, such connectors are at least to some degree preferably placed in tension tending to pull such leading and trailing carriers 36 toward each other thereby maintaining pivotal integrity of the respective pivot means 140 and 148. Further, each of the elastomeric connectors have their respective lower end surfaces 178 in operative abutting engagement with the base portions of upper elastomeric tracks 76 and 78 (also typically illustrated in FIG. 9) as to thereby provide vertical support for the portions 76' and 78' of the tracks 76 and 78 which bridge the space between succeeding carriers 36.

In order to prevent items from falling downwardly through the space between succeeding carrier modules, as well as to prevent any person from catching, for example, the heel of his shoe in such space, tread plate or cover means 180 are provided generally as between such succeeding carriers 36 in order to cover the spaces therebetween. One of the tread plates 180 is fragmentarily illustrated in FIG. 10 with remaining portions thereof, for purposes of overall clarity, illustrated in phantom line.

Figure 12:
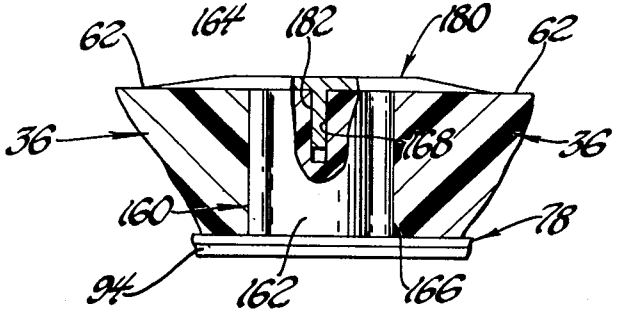
FIG. 12 is an enlarged fragmentary cross-sectional view taken generally on the plane of line 12—12 of FIG. 10 and looking in the direction of the arrows.

FIG. 12, an enlarged fragmentary view taken generally on the plane of line 12—12 of FIG. 10, with certain portions thereof in cross-section and other portions shown in elevation, illustrates a preferred arrangement for anchoring the tread plate 180. That is, each of the tread plates is of a width sufficient to cover the space between succeeding carriers 36, even when such carriers are undergoing articulated motion, and are of a length sufficient to cover the space across the width of the carrier floor 62. Further, a pair or pins or anchor rods 182 (one of which is shown in FIG. 12) are carried by the tread plate 180 at the underside thereof. The anchor rods 182 are spaced from each other a distance substantially equal to the spacing between apertures 168 of mounted connectors 158 and 160 and are of a cross-sectional configuration and size permitting the insertion of such anchor rods 182 respectively in apertures 168 as typically depicted in FIG. 12. The use of such cooperating pins 182 and apertures 168 enables the associated tread plate to simultaneously and correspondingly alter its relative position in accordance with any induced tension or contraction experienced by the connectors 158 and 160 during articulation of joined carriers 36.

Referring to FIGS. 6, 7 and 10, it can be seen that, somewhat similar to the wheel assemblies 84 supporting the carriers 36, roller or wheel means 156 are employed for rollingly supporting the transfer carrier sections or modules 38. That is, a first plurality of V-like annular grooves 184 and 186 are formed near one axial end of each of the wheel means 156 while a second plurality of V-like annular grooves 188 and 190 are formed near the other axial end of each of such wheel means 156. Such V-type grooves accommodate the placement generally thereabout of coacting endless belt means 192 and 194 as typically illustrated in FIG. 10.

For example, referring in greater detail to FIG. 10, which illustrates only two of the wheel means 156, it can be seen that a first plurality of endless belts 192 are operatively engaged with the wheel means 156 in one set of V-grooves while a second plurality of continuous spacer belts 194 are operatively engaged with the wheel means 156 in the opposite set of grooves.

That is, a one of the first plurality of continuous belts 192 is shown being looped about and in the V-groove 186 of the uppershown wheel means 156 as well as being looped about and in the V-groove 186 of the lower-shown wheel means 156. Similarly, a one of the second plurality of continuous belts 194 is shown being looped about and in the V-groove 188 of the uppershown roller means 156 as well as being looped about and in the V-groove 188 of the lower-shown roller means 156.

A second of the first plurality of continuous spacer belts 192 is shown being rollingly engaged in V-groove 184 of the uppershown roller means 156 and extending to the next trailing roller means (not shown) for operative engagement therewith while a third of the first plurality of continuous spacer belts 192 is shown being rollingly engaged in V-groove 184 of the lower-shown roller means 156 and extending to the next leading roller means (not shown) for similar operative engagement therewith.

Further, a second of the second plurality of continuous spacer belts 194 is shown being rollingly engaged in V-groove 190 of the upper-shown roller means 156 and extending to the next trailing roller means (not shown) for operative engagement therewith while a third of the second plurality of continuous spacer belts 194 is shown being rollingly engaged in V-groove 190 of the lower-shown roller means 156 and extending to the next leading roller means (not shown) for similar operative engagement therewith. As generally described above and depicted in FIG. 10, the series of spacer belts 192 and 194, which are preferably elastomeric, function to, in turn, interconnect the roller means 156 into a functionally closed loop rolling support system for supporting the transfer carriers 38. It should be mentioned that the center-to-center distance of succeeding roller or wheel means 156 is such as to result in at least two wheel or roller means 156 being beneath each transfer carrier 38 at any particular time.

Figure 13:
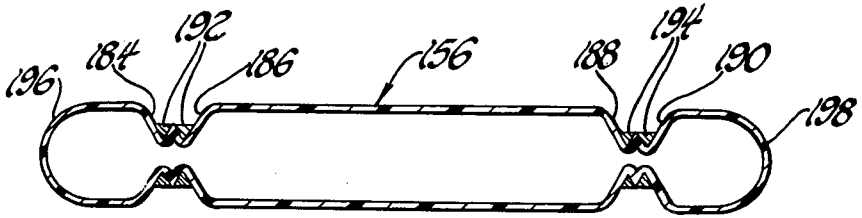
FIG. 13 is an enlarged cross-sectional view, of one of the elements shown in FIG. 10, taken generally on the plane of line 13—13 of FIG. 10 and looking in the direction of the arrows.

The preferred embodiment of the wheel means 156 is typically illustrated in greater detail in FIG. 13. That is, the wheel or roller means 156 is shown as being of a hollow configuration with V-groove annular recesses 184 and 186 formed near one end thereof and similar V-groove annular recesses 188 and 190 formed near the other end thereof.

Preferably, the ends 196 and 198 of each of the roller means 156 are formed to have a generally spherical configuration as to thereby be guidingly received generally within mating surfaces 200 and 202 of each of the support platforms 134 for supporting the transfer carriers 38, as best shown in FIG. 7. As also illustrated in FIG. 7 (as well as in FIGS. 6 and 10) the contoured guide or end surfaces 200 and 202 blend with a lower planar support surface 204.

Figure 14:
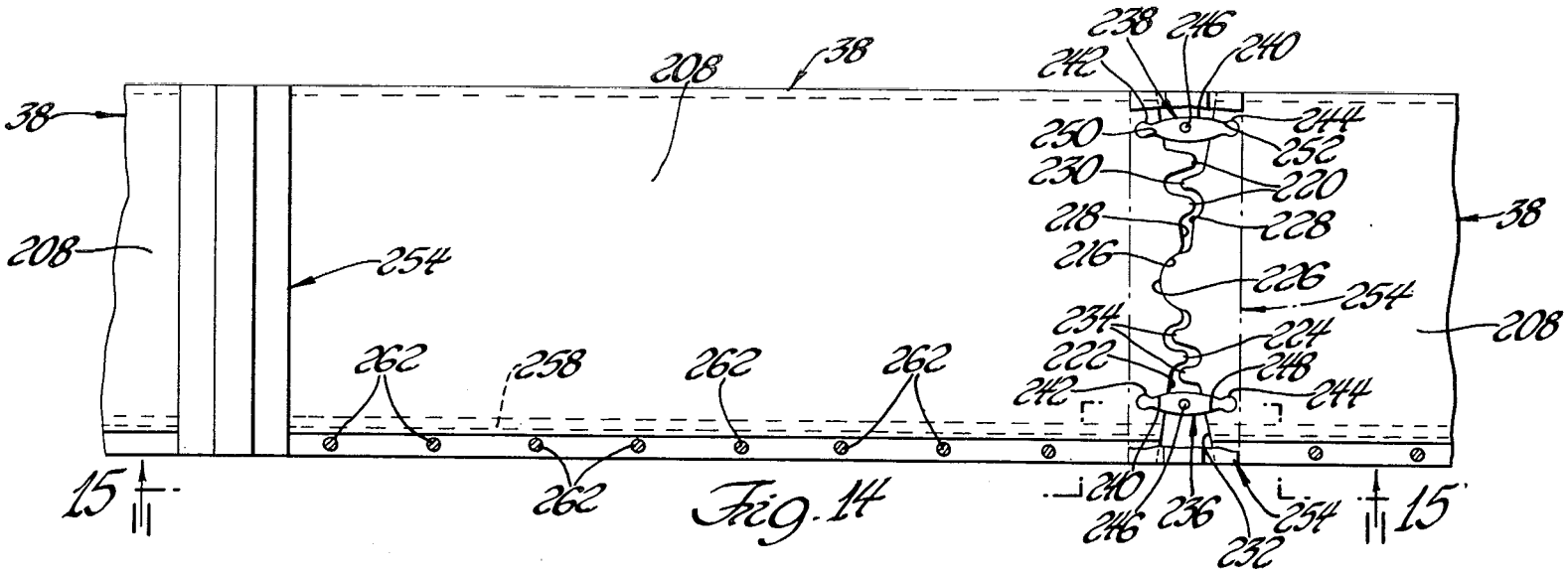
FIG. 14 is a view taken generally on the plane of line 14—14 of FIG. 7 and looking in the direction of the arrows.

FIG. 14, a fragmentary top plan view of the transfer sections or carriers 38, taken generally on the plane of the 14—14 of FIG. 7, illustrates the sections 38 as being comprised of a generally laterally extending body 206 defining an outer walk or floor surface 208 as well as a planar support surface 210 (also see FIGS. 7 and 15) effective to be in rolling engagement with the roller means 156 (FIGS. 7, 10 and 13). Further, similar to contoured surfaces 212 and 214 which blend with planar surface 210.

FIG. 14 also illustrates the manner in which two succeeding modular transfer carriers 38 may be operatively connected to each other. For example, the forward or leading end of each of the transfer carriers 28 may be provided with a socket-like bearing surface or recess 216 with a first end surface 218 generally blending with the recess 216 and comprising a plurality of finger-like projections or extensions 220. A second leading end surface 222, generally inclined with respect to a transverse plane normal to the carrier 28 (as is the first end surface 218), also comprises at least one finger-like projection 224.

The trailing end of each of the transfer carriers 38 may be provided with an arcuate projection 226 pivotally received in and cooperating with recess 216. A first trailing end surface 228 blends with arcuate projection 226, in a manner as to be generally inclined with respect to a transverse plane normal to the carrier 38, and may comprise at least one finger-like projection 230. A second trailing end surface 232, also inclined with respect to a transverse plane normal to the carrier 38, may comprise a plurality of finger-like projections 234.

As illustrated, the leading fingers 220, 224 and trailing edge fingers 230, 234 are so spaced and of such effective lengths as to place such fingers or extensions in a generally interleaved relationship and to permit substantial arcuate or pivotal motion of succeeding carriers generally about the axis of recess 216 or bearing means defined by 216 and 226. As could be evident, such interspersed fingers or extensions serve to provide an effectively continuous supporting surface for rolling engagement across the top of the wheel or roller support means 156 while still enabling a degree of relative arcuate movement as between succeeding transfer carriers 38.

The respective succeeding pairs of carriers 38, as also best illustrated in FIG. 14, are effectively joined to each other as by spaced connecting members 236 and 238. Typically each of such connectors 236 and 238 may be comprised of a main generally elongated body 240 having integrally formed anchoring portions 242 and 244 coextensive with the vertical length of such body 240. Further, in the preferred form, each of the connectors has an aperture 246 formed in the body portion 240. Each of the connectors 236 and 238 are formed of a suitable elastomeric material.

Still referring to FIG. 14, a first cut-out or opening 246, formed in the leading end of the trailing transfer carrier 38, closely conforms to the outer configuration of connector 236 and accepts therein a portion of body 240 as well as anchor portion 242; another portion of body 240 and the opposite anchor portion 244 of the same connector 236 are similarly received in a cut-out or opening 248 formed in the trailing end of juxtaposed leading carrier 38. The trailing transfer carrier 38 has a second cut-out or opening 250 which closely conforms to the outer configuration of connector 238 and accepts therein a portion of body 240 as well as its anchoring portion 242; another portion of body 240 and the opposite anchoring portion 244 are similarly received in a cut-out or opening 252 formed in the trailing end of the leading transfer carrier 38.

When such elastomeric connectors 236 and 238 are so assembled to any two succeeding transfer carriers 38, such connectors are at least to some degree preferably placed in tension tending to pull such leading and trailing carriers 38 toward each other thereby maintaining pivotal integrity of the respetive pivot means 216 and 226.

In order to prevent items from falling downwardly through the space between succeeding transfer carriers 38, as well as to prevent any person from catching, for example, the heel of his shoe in such space, tread plate or cover means 254 are provided generally as between such succeeding carriers 38 in order to cover the spaced therebetween. One of the such tread plates is illustrated, for purposes of clarity, partly in phantom line.

Figure 15:
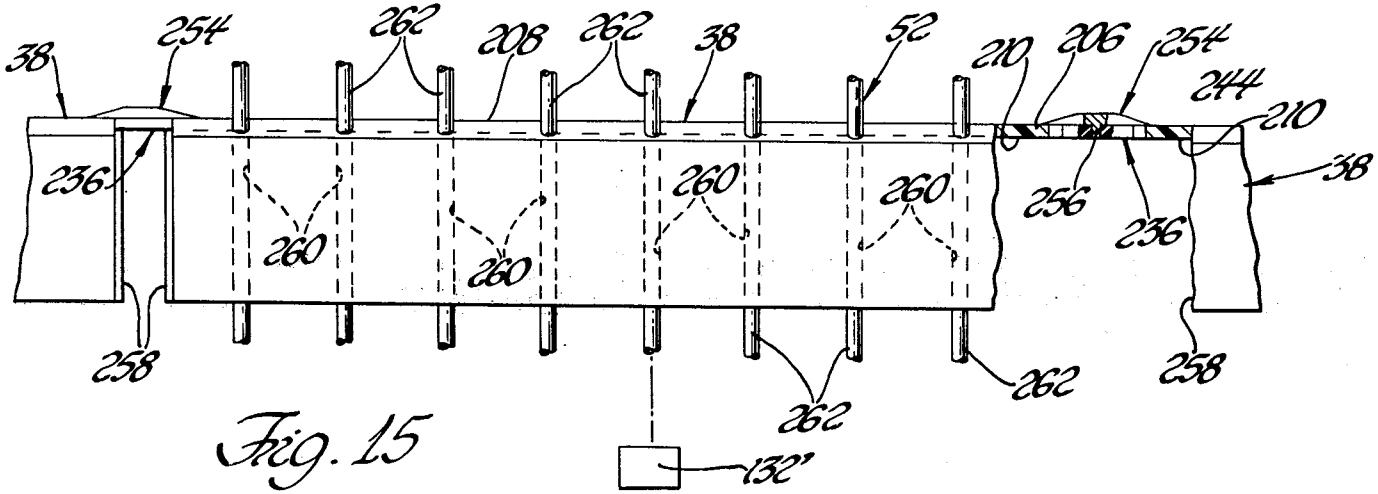
FIG. 15 is a view taken generally on the plane of line 15—15 of FIG. 14 and looking in the direction of the arrows.

Preferably, each of the cover plates 254 is provided with a pair of downwardly depending pins or anchor rods 256 (one of which is shown in FIG. 15) which are spaced from each other a distance substantially equal to the spacing between apertures 246 of mounted connectors 236 and 238 and, further, are of a cross-sectional configuration and size permitting the insertion of such anchor rods 256 respectively in apertures 246 as typically depicted in FIG. 15. The use of such cooperating pins 256 and apertures 246 enables the associated tread plate to simultaneously and correspondingly alter its relative position in accordance with any induced tension or contraction experienced by the connectors 236 and 238 during articulation of joined transfer carriers 38.

As illustrated in each of FIGS. 7, 10, 14 and 15, each of the transfer carriers 38 is preferably provided with an outer downwardly extending side wall 258 which has a plurality of guide passages 260 formed therein as for the slideable reception therein of banisters 262 of the gate or barrier means 52. Just as with respect to barrier means 120, any suitable means can be employed for raising and lowering gate means 52 as generally schematically illustrated at 132' of FIG. 15. Such means may take the form of electric or pneumatic motors, for example, and, if desired, using any such appropriate motor in combination with negator-type springs. Such negator springs are well known in the art for use in circumstances where it is desired to effectively off-set or counter-balance the weight of a related member which, in this instance, would be the gate means 52. The precise means by which such barrier means are raised and lowered forms no part of this invention and, of course, the practice of this invention is not limited to any such specific actuating or control means.

Various propulsion means may be employed for propelling both the closed loop transporter means 12 as well as the related closed loop transfer means 14. However, in the preferred embodiment of the invention, it is contemplated that linear induction type electrical motor means would be employed. For example, referring in greater detail to FIGS. 6 and 7, first linear induction motor means may be provided as generally depicted at 264 while second linear induction motor means may be provided as generally depicted at 266.

Generally, linear induction motors are known in the art and therefore such need not be here described in detail. However, it should be mentioned that generally, there are two related functional sections one of which is often referred to as the stator and the other, the armature or rotor. The stator is usually provided with an electrically energizeable winding, which, when so energized, creates a magnetic field about such winding and at the same time induces a current into armature which, in turn, produces its own resulting second magnetic field. The two magnetic fields react or repel each other thereby creating relative linear motion as between the stator and the armature or rotor. For purposes of reference, and not by way of limitation, the terms stator and armature will be used in combination with induction motor means 264 and 266.

As depicted, motor means 264 may be comprised of a stator 268 suitably fixedly mounted on a support 270 which, in turn, may be carried as by a related structure as, for example, a wall 272. The stator means 268 would extend, in a generally closed loop fashion, as to be coextensive with the closed loop transporter means 12. However, as should be apparent, such stator means 268 may be comprised of a plurality of linearly juxtaposed stator sections which, for practical reasons would almost certainly be required in order to enable ready manufacturing and installation thereof.

In comparison the armature means 274 would be suitably fixedly secured to the moving transporter means 12 as by related support means 276. Similar to the stator means 268, the armature means 274 would also extend, in a generally closed loop fashion, as to be coextensive with the closed loop transporter means 12 and the stator means 276. Further, the armature means 274 may also be sectionalized into modular lengths (for example, lengths generally equal to the length of a carrier 36) and thusly carried by the individual modular carriers 36.

Motor means 266 may be comprised of a stator 278 suitably fixedly mounted on rib-like support means 136 while the armature means 280 would be fixedly secured to and carried by the depending wall 258 of the transfer carrier modules 38. As explained with regard to motor means 264, the stator means 266 and armature means 280 may be similarly sectionalized and placed generally linearly juxtaposed to define respective cooperating closed loops.

The current for the motor means 264 may be obtained as through suitable conductor means generally schematically shown at 282 and 284 while the current for motor means 266 may be obtained through suitable conductor means generally schematically shown at 286 and 288 cooperating with, for example, a sliding rolling or wiper contact arrangement leading to a related source of electrical potential.

Figure 16:
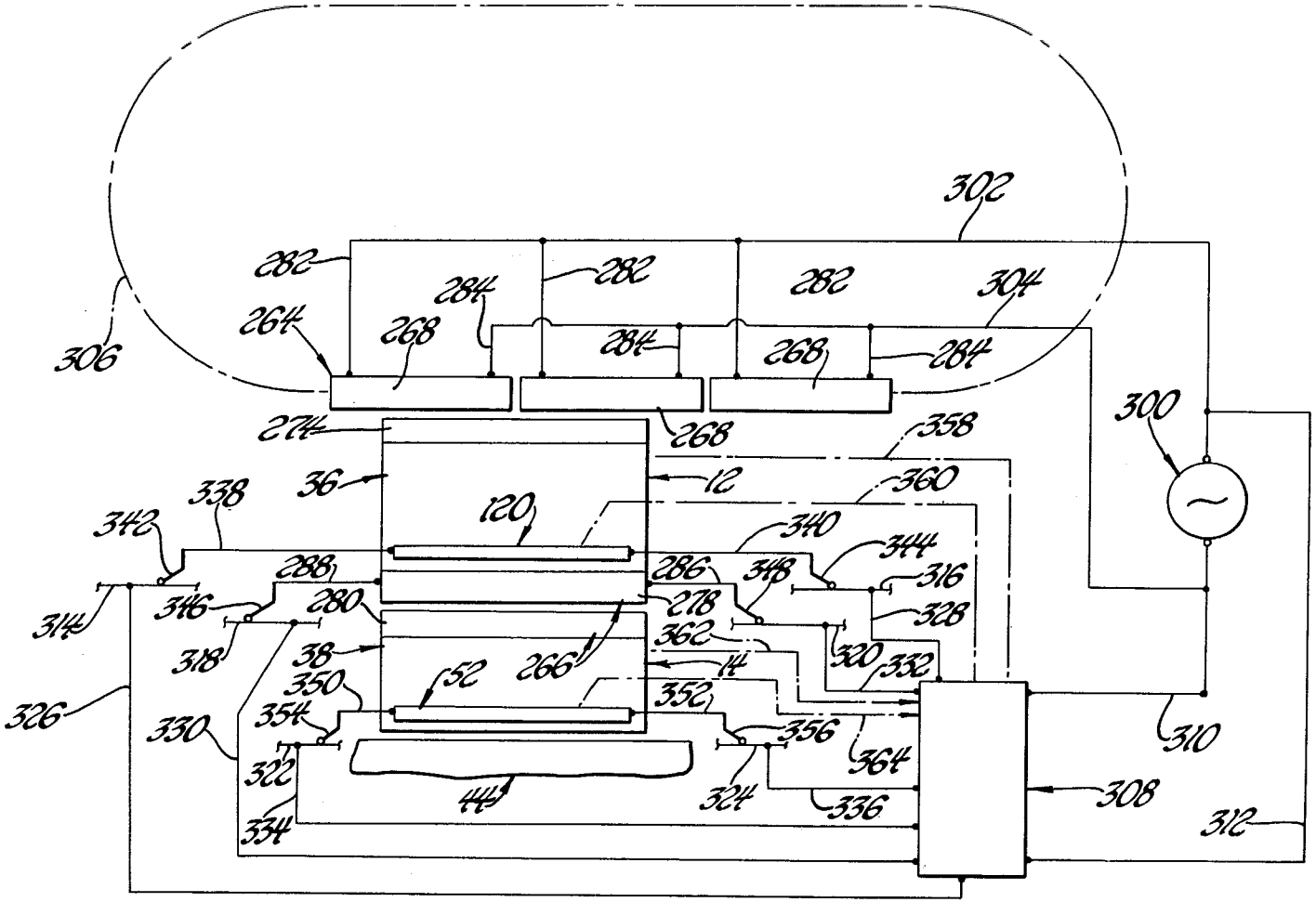
FIG. 16 is partly a schematic and partly diagrammatic illustration of the general electrical wiring arrangement employable in the invention.

FIG. 16, partly schematically and partly diagrammatically, illustrates the general electrical wiring arrangement as might be applied to the preferred embodiment of the invention as typified by its application to a single transporter carrier 36 and a coacting single transfer carrier 38.

Referring in greater detail to FIG. 16, a few of the linearly juxtaposed stator means 268 are typically shown as being in electrical circuit with a suitable source of electrical potential 300 as by conductor means 302 and 304 cooperating with leads 282 and 284, respectively. The remaining stators 268 would be placed in a closed loop fashion as generally schematically depicted by the phantom line 306 (which, as should be apparent, is coextensive with the closed loop transporter means 12 represented in FIG. 16 by the single carrier 36).

A plurality of fixed or stationary rail-like electrical contact means may also be provided in a manner whereby each of such plurality defines a separate closed loop configuration generally coextensive with the other closed loops of the transit system. Such stationary electrical contact means are respectively fragmentarily schematically depicted at 314, 316, 318, 320, 322 and 324. Suitable control means 308 may be electrically connected as via conductor means 310 and 312, to source 300, is also electrically connected to stationary contacts 314, 316, 318, 320, 322 and 324 as by conductor means 326, 328, 330, 332, 334 and 336, respectively.

Electrical conductors 338 and 340, leading to the actuator means 132 of diagrammatically illustrated barrier or gate means 120, are respectively electrically connected to movable (for example, rolling or sliding) electrical contacts 342 and 344 which are in operative engagement with fixed contact means 314 and 316, respectively. Conductors 288 and 286 leading to the stator 278 are respectively electrically connected to moveable electrical contacts 346 and 348 which are in operative electrical engagement with fixed contact means 318 and 320, respectively, while electrical conductors 350 and 352 leading to the actuator means 132' of diagrammatically illustrated barrier or gate means 52, are respectively electrically connected to moveable electrical contacts 354 and 356 which are in operative electrical engagement with fixed contacts 322 and 324, respectively.

As generally depicted by the phantom lines, suitable feedback means 358, 360, 362 and 364 may also be provided. For example, feed-back means 358 may be employed for providing a feed-back signal to control means 308 indicative of the speed of the carrier 36 (which would in effect be the speed of the closed loop transporter means 12); feed-back means 362 may be employed for providing a feed-back signal to control means 308 indicative of the speed of transfer carrier 38 (which would in effect be the speed of the closed-loop transfer means 14); feed-back means 360 may be employed for providing a feed-back signal to control means 308 indicative of the position of gate means 120; while feed-back means 364 may be employed for providing a feed-back signal to control means 308 indicative of the position of gate means 52.

Referring to, for example, FIGS. 1 and 16, the operation of the invention would be as follows. Source of electrical potential 300 (whether such be a single source or a plurality of sources) would cause continuous energization of stator means 268 of first motor means 264 thereby causing the transporter means 12 and the transfer means 14 carried thereby to undergo motion in their respective closed loop paths. Assuming that both means 12 and 14 are at the same or substantially same velocity, control means 308 would energize the actuator means 132 causing gate means 120 to become opened and thereby permitting passengers on transfer carriers 38 to step onto transporter carriers 36 as well as permitting passengers on the transporter carriers 36 to step onto transfer carriers 38. After an appropriate length of time (for example, 15.0 seconds) control means 308 would cause gate means 120 to again become closed and then start to energize stator means 278, of second motor means 266, so as to cause such motor means 266 to start to propel the transfer means 14 in a direction reverse to the direction of travel of transporter means 12. By so doing, the apparent effect to anyone, for example, on the stationary platform means 44 would be that the transfer means 14 was undergoing deceleration with respect to such stationary platform means 44. Such deceleration of transfer means 14 would continue until its velocity with respect to transportor means 12 resulting in transfer means being stationary with respect to the stationary platform means 44. Such period of deceleration may consume, for example, another 15.0 seconds.

At this point it should be brought out that theoretically there is no energy loss because of the deceleration of the closed loop transfer means 14 because whatever force is generated to start propelling such transfer means 14 in a direction opposite to the travel of the closed loop transporter means 12 results in an oppositely directed reaction from which assists in maintaining the propulsion of the transporter means 12, and, in fact, may actually generate a greater forward propulsion force in transporter means 12 than that which is generated by its own normal propulsion means.

When the transfer means 14 is finally stationary relative to the stationary platform means 44, control means 308 then energizes actuating means 132' of gate means 52 causing the gate means 52 to open thereby permitting any passengers on the transfer means 14 to step onto the stationary platform 44 as well as permitting any persons wishing to board the transit system to step from the stationary platform means 44 onto the carriers 38 of the closed loop transfer means 14. After an appropriate length of time (for example, 15.0 seconds) control means 308 would again close gate means 52 and energize the second motor means 266 as to cause the transfer means 14 to start to reduce its speed relative to the continuously moving transporter means 12 thereby creating the apparent effect of accelerating, in the same direction of travel as that of transporter means 12, with respect to the stationary platform means 44. Such apparent acceleration would continue (for example, 15.0 seconds) until transfer means 14 was again at substantially the same velocity as the transporter means 12. At this time control means 308 would again energize actuating means 132 and the previously described cycle would start to repeat.

As shown in, for example, FIGS. 6 and 7, the entire transit system may also be provided with a suitable ventilation system comprised of a source 366 effective for supplying temperature regulated air to cooperating ducting 368. The ducting or passage means 368 may be contained as generally illustrated so as to effectively extend for the entire length of the transit system.

Cooperating passage means 370, 372, provided at spaced intervals along the transit system, werve to communicate between the interior of passage means 368 and the space below the transporter means 12 and transfer means 14. Air thusly supplied for the climate control of the interior of the entire transit system would flow from beneath the closed loop means 12 and 14, through the relatively small spaces as between moving components and stationary structure and into the area generally above the closed loop means 12 and 14. In so doing, there would be a slight pressure differential created generally vertically across the closed loop means 12 and 14 tending to lift such means 12 and 14. The lifting action thereby created would reduce the loading on the suspension system and further soften the ride characteristics of the transit system as well as reduce frictional losses.

Although not necessary to the practice of the invention, FIG. 5, nevertheless, illustrates the contemplated possibility of employing a belt-like continuously moving side-walk system 374 employing a moving portion 376 carrying seating means 378 thereon. This could be an advantage especially in situations where the transit system in either elevated or subterranean thereby otherwise requiring those using the transit system to enter and leave the transit system via conventional stairways which, as is common knowledge, create difficulties for the aged and completely make it impossible for anyone, for example, confined to a wheelchair to use the transit system. The moving side-walk system 374, moving from one level to another, would of course, enable such persons to enjoy the full benefits of the transit system.

FIGS. 17, 18, 19, 20, 21 and 22, each based on a view as that of FIG. 7 but greatly simplified for purposes of clarity, typically illustrate various modifications of the invention. Further, for ease of reference and correlation, elements in FIGS. 17–22 which are like or similar to those of FIG. 7 are identified with like reference numbers.

Figure 17:
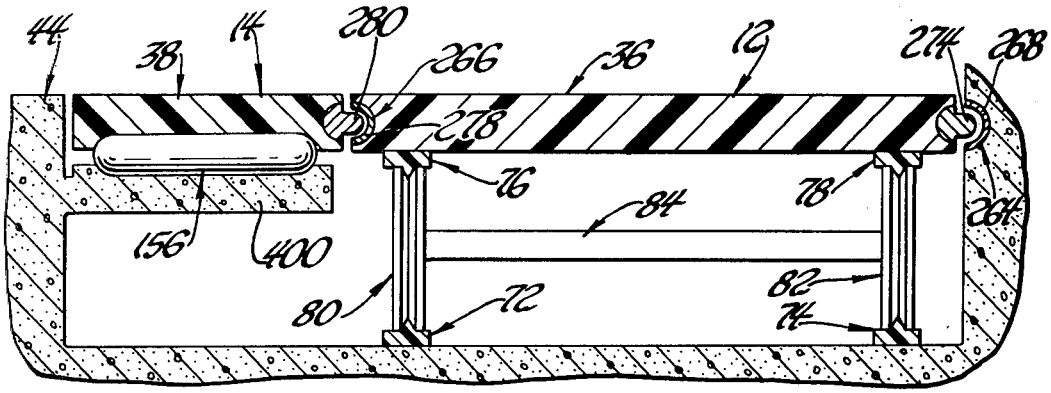
FIGS. 17, 18, 19, 20, 21 and 22, each based on a view as that of FIG. 7 but greatly simplified for purposes of clarity, typically illustrate various modified forms of the invention.

In comparing FIGS. 17 and 7, it can be seen that the main difference therebetween resides in the elimination of the support flange 134, provided by the carrier 36 in FIG. 7, and the substitution therefor of a stationary support track or flange 400 carried as by the platform means 44.

Figure 18:
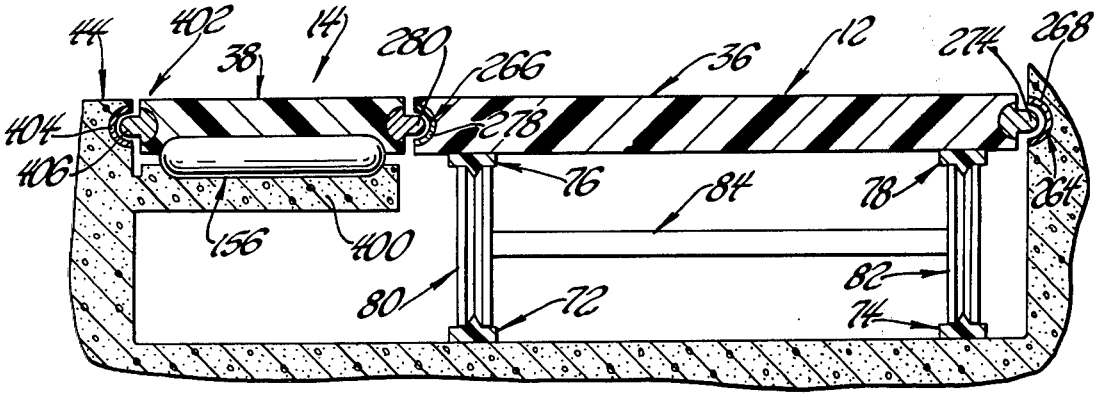

FIG. 18 corresponds to the arrangement depicted by FIG. 17 with the exception that an additional motor means 402 may be provided, as shown, and comprised of stator means 404 and coacting armature means 406. In this arrangement motor means 266 could be employed for decelerating closed loop transfer means 14 with respect to platform means 44 while motor means 402 could be employed for accelerating the transfer means 14 with respect to platform means 44.

Figure 19:
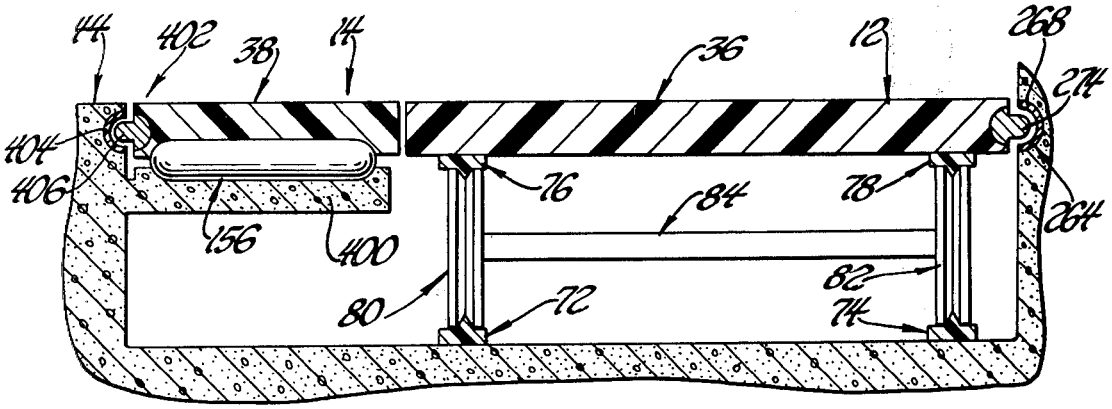

FIG. 19 corresponds to the arrangement shown in FIG. 18 with the exception that motor means 266 of FIG. 18 is eliminated. In this arrangement the acceleration and deceleration of transfer means 14 is achieved by motor means 402 with the reaction force being against the stationary platform means 44 or some such stationary structure.

Figure 20:
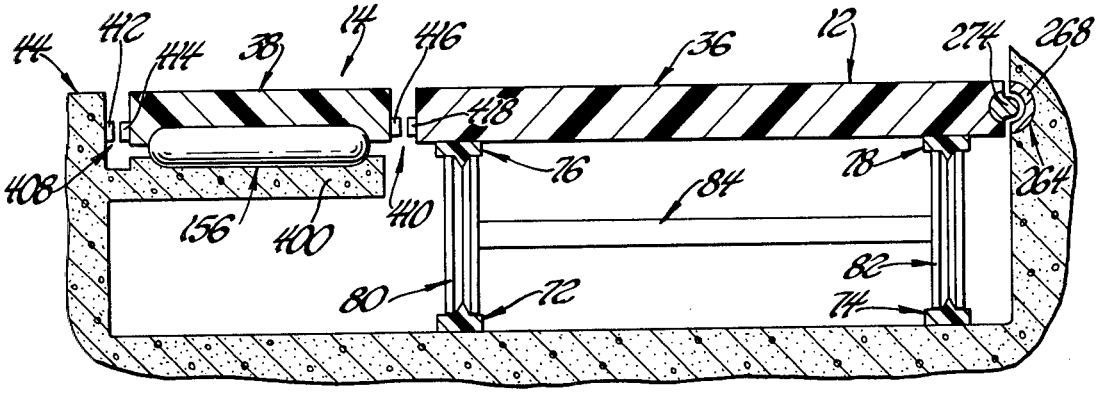

FIG. 20 corresponds to, for example, the arrangement shown in FIG. 17 with the exception that instead of motor means 266 brake means 408 and 410, as respectively schematically depicted by coacting brake shoes 412, 414 and 416, 418. In this arrangement, the brake means 410 would be energized in order to accelerate transfer means 14 with respect to platform means 44 and to thereafter hold the transfer means 14 at a constant speed or in unitary motion with transporter means 12, while brake means 408 would be energized to decelerate transfer means 14 with respect to platform means 44 and to thereafter hold the transfer means 14 stationary with respect to platform means 44 during appropriate portions of the overall operating cycle.

Figure 21:
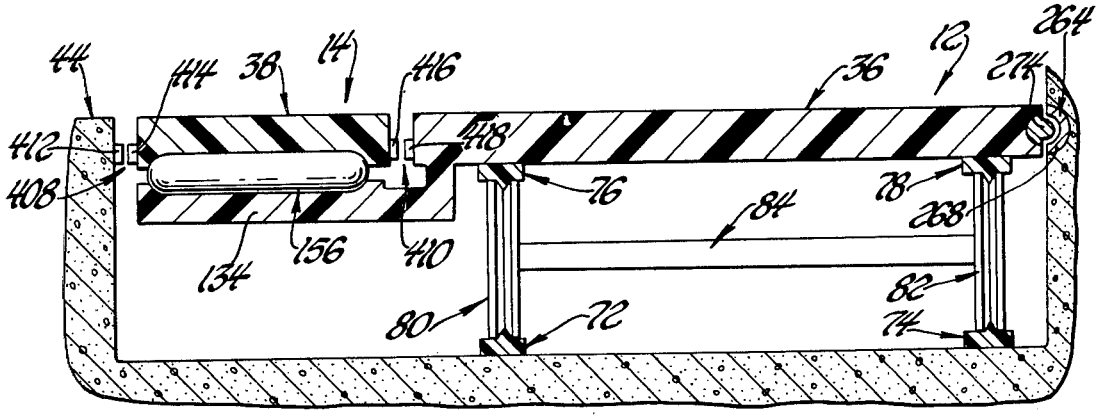

FIG. 21 corresponds to the arrangement of FIG. 20 with the exception that the stationary support 400 has been replaced by the moveable support 134 for the transfer means 14. Otherwise the operation is as described with reference to FIG. 20.

Figure 22:
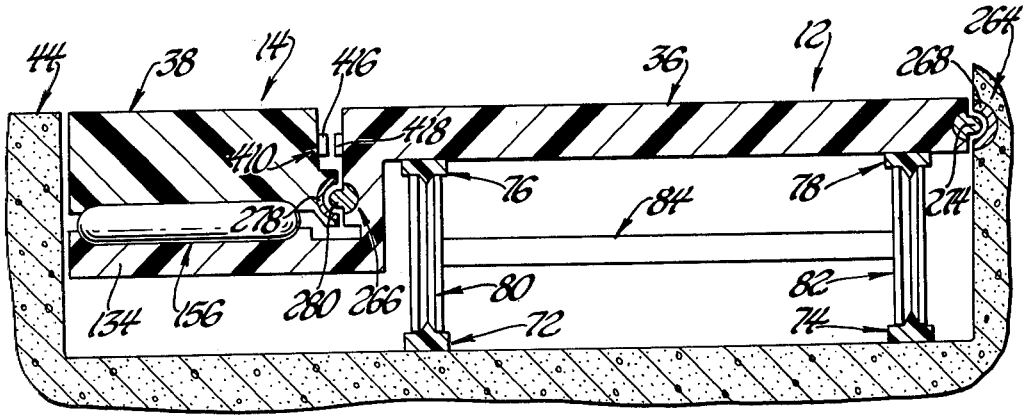

The structure of FIG. 22 may be considered as somewhat a combination of the arrangements of FIGS. 7 and 21 with the exception that brake means 408 of FIG. 21 has been eliminated. In the arrangement of FIG. 22, the motor means 266 could be employed, as described with reference to FIG. 7, for decelerating transfer means 14 with respect to stationary platform means 44 and to eventually maintain transfer means 14 stationary with respect to platform means 44, while brake means 410 could be energized, as described with reference to FIG. 21, to accelerate transfer means 14 with respect to platform means 44 and eventually hold such transfer means 14 in unitary motion with transporter means 12.

It should, of course, be apparent that the various motor means 406 and brake means 408, 410 of FIGS. 17–22 may be connected in suitable control circuits generally consistent with FIG. 16.

Figure 23:
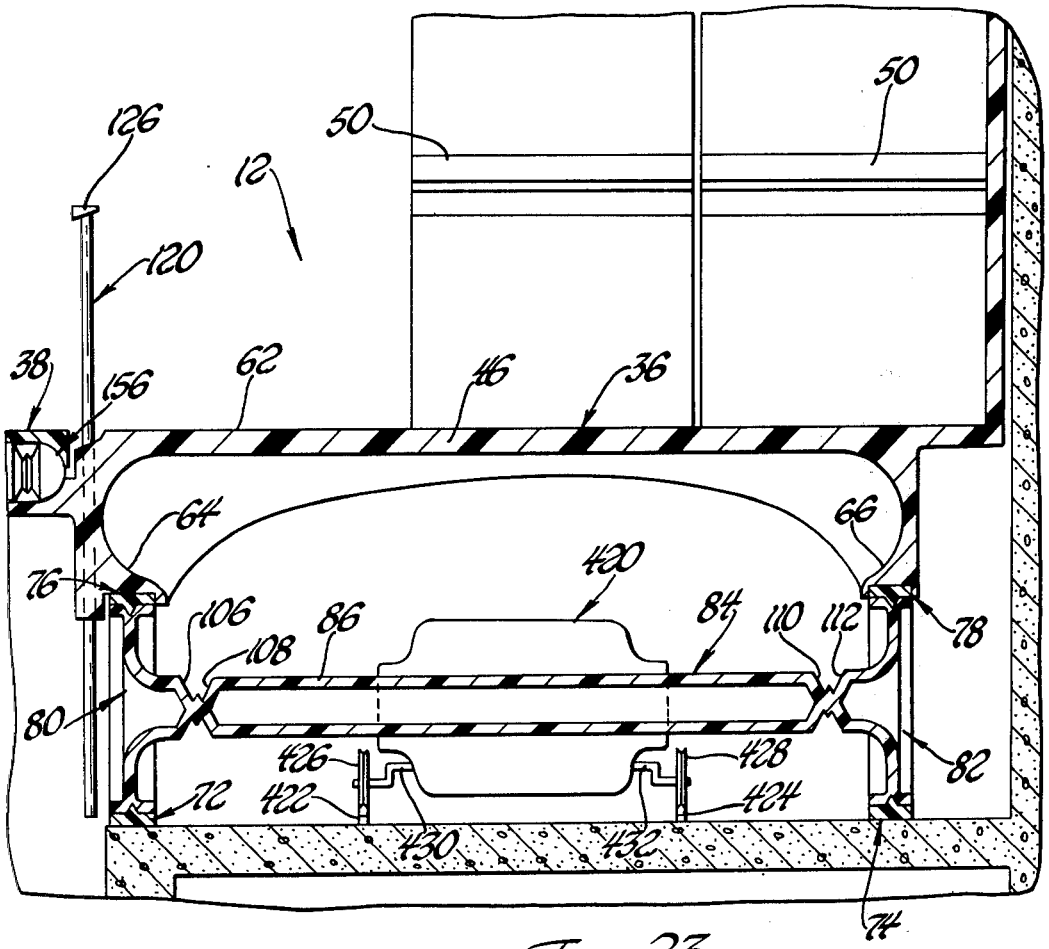
FIG. 23, a view generally similar to that of FIG. 7, illustrates a modified form of propulsion means.

FIG. 23, a view generally similar to that of FIG. 7, illustrates another modified form of propulsion. All elements in FIG. 23 which are like or similar to those of FIG. 7 are identified with like reference numbers. In comparing FIGS. 7 and 23, it can be seen that the basic difference therebetween resides in the elimination of the linear induction motor means 264 and the substitution therefor of rotary type electric motor means as generally depicted at 420. A plurality of such motor means 420 may be respectively situated generally in combination with selected wheel assemblies 84 so as to drive the wheels 80 and/or 82 and thereby provide propulsion from the transit system. In such an arrangement it is contemplated that a plurality of electrical rail-like conductors 422 and 424 would provide the electrical current to motor means 420 via rolling wheel-like contacts 426 and 428 carried as by axle means 430 and 432. In such an arrangement, the reaction torque of the motor means 420 may be applied through the axle means 430, 432 and contacts 426, 428 to the rails 422, 424.

Figure 24:
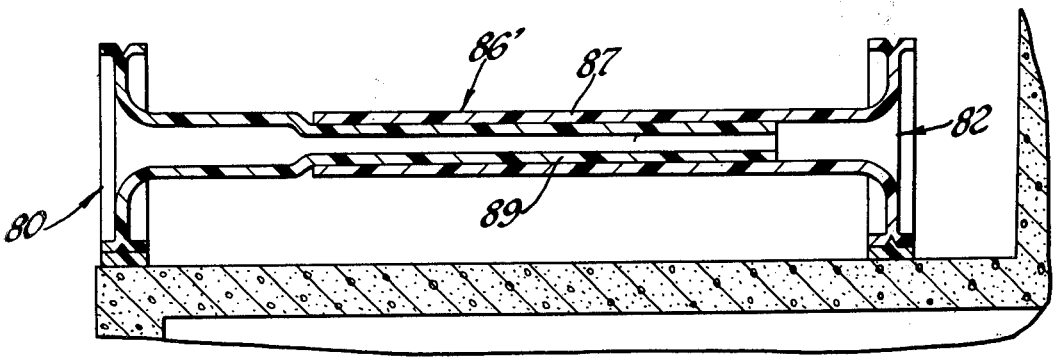
FIG. 24, an axial cross-sectional view, illustrates a modified form of a suspension wheel assembly.

It should be apparent that the invention is not limited to the use of wheel assemblies which are unitary or integrally formed throughout. Accordingly, FIG. 24 is presented merely to pictorially illustrate that the wheels 80 and 82 may be journalled with respect to each other and that further, if desired, the axle section 86′ thereof may be comprised of generally telescoped and relatively rotatable portions 87 and 89.

Figure 25:
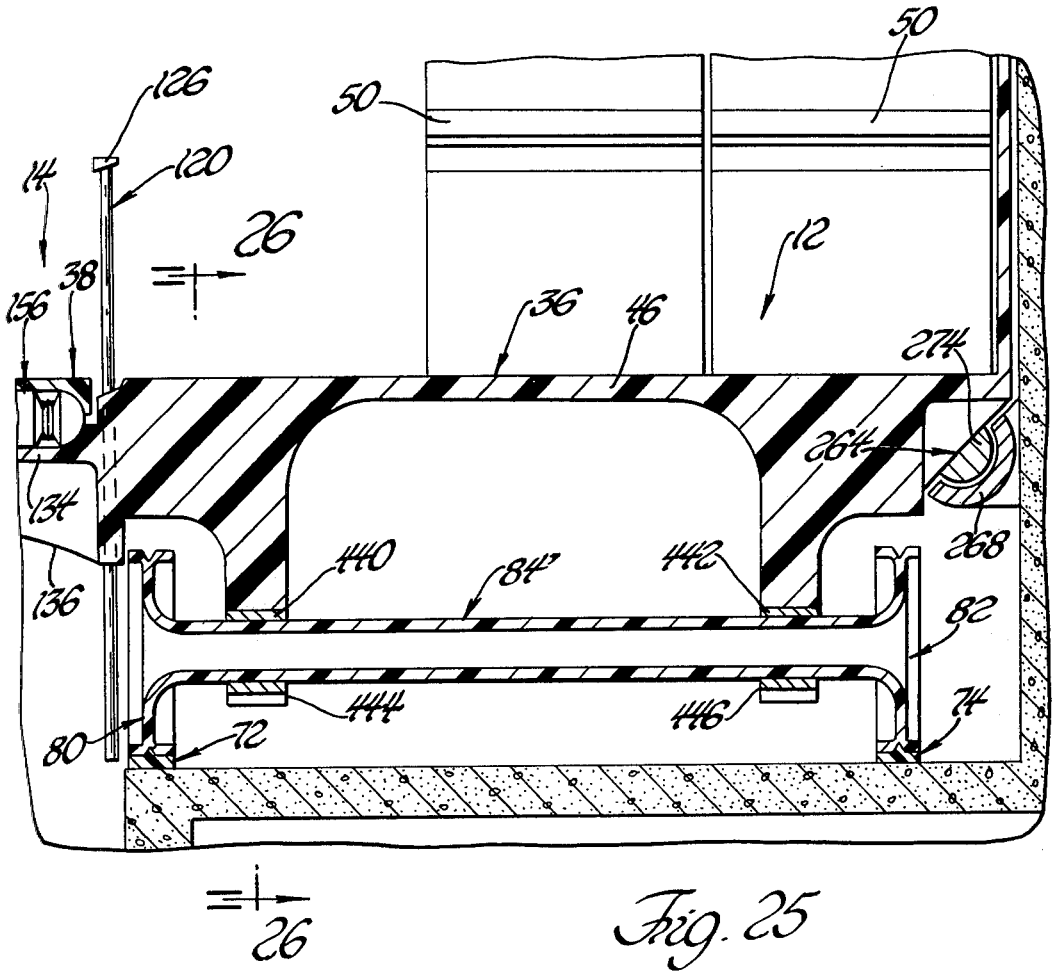
FIG. 25, a view generally similar to that of FIG. 7, illustrates another modified form of suspension means.
Figure 26:
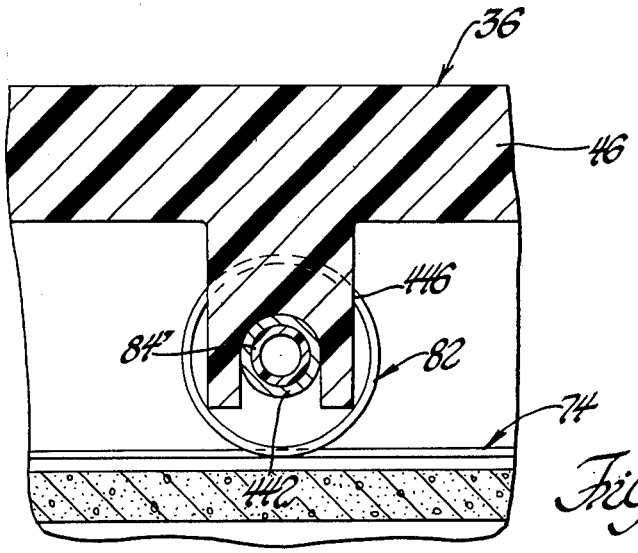
FIG. 26 is a fragmentary cross-sectional view taken generally on the plane of line 26—26 of FIG. 25 and looking in the direction of the arrows.

FIG. 25, a view similar to that of FIG. 7, illustrates the fact that wheel assemblies need not be in free rolling engagement with the carriers 36 but may be journalled as by suitable bearing means 440, 442 carried within downwardly depending journal box structures 444, 446. Further, as previously indicated, it is not essential that wheels 80 and 82 be relatively rotatable with respect to each other.

In addition to the preferred embodiment and the various modifications herein specifically disclosed other modifications and embodiments are possible. For example, it is entirely possible that the various carriers herein disclosed could be situated atop railroad-type truck assemblies instead of the various forms of wheel assemblies herein disclosed.

Accordingly, although only one preferred embodiment of the invention and a limited number of modifications of the invention have been disclosed and described, it is apparent that other embodiments and modifications of the invention are possible within the scope of the appended claims.

I claim:

1. A method of transporting an entity to be transported from a first stationary station area to a second stationary station area, comprising the steps of transferring said entity from said first stationary station area to a second area defined by first means standing in stationary relationship to said first stationary station area, accelerating said first means until said first means attains a velocity substantially equivalent to the existing velocity of second means defining a third area contiguous to said second area, transferring said entity from said second area to said third area, transporting said entity on said third area at said existing velocity for a distance less than the distance between said first stationary station area and said second stationary area, transferring said entity from said third area while at said existing velocity to said second area, controllably decelerating said first means from said existing velocity until said first means attains a stationary relationship with respect to said second stationary station area, and transferring said entity from said second area to said second stationary station area.

2. A method of transporting an entity to be transported according to claim 1 and further comprising the step of positively preventing the transfer of any such entity from said first stationary station area to said second area whenever said first means is not standing in stationary relationship to said first stationary station area.

3. A method of transporting an entity to be transported according to claim 1 and further comprising the step of positively preventing the transfer of any such entity from said second area to said third area whenever said first means is not at said existing velocity.

4. A method of transporting an entity to be transported according to claim 1 and further comprising the steps of positively preventing the transfer of any such entity from said first stationary station area to said second area whenever said first means is not standing in stationary relationship to said first stationary station area, and positively preventing the transfer of any such entity from said second area to said third area whenever said first means is not at said existing velocity.

5. In a method of transportation coordination wherein entities are to be transported from one station to another, the improvements comprising the steps of supporting said entities on a primary carrier, supporting said entities on a secondary station, supporting said entities on a tertiary carrier, first imparting translation at substantially constant non-zero speed on said primary carrier with respect to said tertiary carrier, secondly imparting translation on said secondary carrier with respect to said primary carrier such that said secondary supporting means translates at the same speed as said primary carrier during a first phase and said secondary carrier translates at the same speed as said tertiary carrier during a second phase, conditioning said secondly imparted translation cyclically from accelerating from said second phase to said first phase and controllably decelerating from said first phase to said second phase, limiting the path of translation of said primary carrier to being fixed at a closed perimeter, maintaining said path and said primary carrier to being simultaneously substantially contiguous throughout their respective lengths, limiting the path of translation of said secondary carrier to being fixed to a closed perimeter, and maintaining said second mentioned path and said secondary carrier to being simultaneously substantially contiguous throughout their respective lengths.

6. The method of claim 5 and maintaining said first and second paths as substantially parallel and separated from one another by a substantially non-varying displacement throughout their respective lengths.

7. The method of claim 5 and maintaining said tertiary carrier as stationary with respect to said one station.

8. The method of claim 5 and arranging said first mentioned path to being curved in part and straight in another part thereof.

9. The method of claim 5 and arranging said primary carrier to have one portion thereof translating in a direction opposite to the direction of translation of another portion thereof with said one portion being immediately adjacent said another portion.

10. The method of claim 5 and separating said tertiary carrier from said primary carrier with said second mentioned path.

11. The method of claim 5 and separating at a substantially non-varying displacement said tertiary carrier and said primary carrier throughout their respective lengths.

12. The method of claim 5 and blocking transfer of said entities from said primary carrier to said secondary carrier during said second imparting during said second phase and acceleration and deceleration between said first and second phases.

13. The coordination of claim 12 and transferring of said entities from said tertiary carrier to said secondary carrier during said blocking.

14. The method of claim 5 and blocking transfer of said entities from said tertiary carrier to said secondary carrier during said second imparting during said first phase and acceleration and deceleration between said first and second phases.

15. The method of claim 14 and transferring of said entities from said primary carrier to said secondary carrier during said blocking.

16. The method of claim 5 and transferring of said entities from said tertiary carrier to said secondary carrier during said second phase.

17. The method of claim 5 and transferring of said entities from said primary carrier to said secondary carrier during said first phase.

* * * * *